US010210695B2

(12) United States Patent
Yamamiya

(10) Patent No.: US 10,210,695 B2
(45) Date of Patent: Feb. 19, 2019

(54) ARTICLE DISPENSING APPARATUS

(71) Applicant: ASAHI SEIKO KABUSHIKI KAISHA, Tokyo (JP)

(72) Inventor: Takahito Yamamiya, Saitama (JP)

(73) Assignee: ASAHI SEIKO KABUSHIKI KAISHA (JP)

( * ) Notice: Subject to any disclaimer, the term of this patent is extended or adjusted under 35 U.S.C. 154(b) by 410 days.

(21) Appl. No.: 14/600,845

(22) Filed: Jan. 20, 2015

(65) Prior Publication Data

US 2016/0012660 A1 Jan. 14, 2016

(30) Foreign Application Priority Data

Jun. 4, 2014 (JP) ..... 2014-115339

(51) Int. Cl.
*G07F 11/16* (2006.01)
*G07F 11/04* (2006.01)
*G07F 11/00* (2006.01)

(52) U.S. Cl.
CPC ..... *G07F 11/16* (2013.01); *G07F 11/005* (2013.01); *G07F 11/04* (2013.01)

(58) Field of Classification Search
CPC .... B65D 83/0418; B65D 83/64; B65D 85/64; G07F 11/04; G07F 11/005; G07F 11/06; G07F 11/16; G07F 11/42
See application file for complete search history.

(56) References Cited

U.S. PATENT DOCUMENTS 1,648,812 A * 11/1927 Johnson ..... G07F 11/04 194/294
2,522,316 A * 9/1950 Steiner ..... G07F 11/16 221/273
2,546,986 A * 4/1951 Dressler ..... A47F 1/10 221/111

(Continued)

FOREIGN PATENT DOCUMENTS

CA 2231131 6/1999
EP 1986166 10/2008

(Continued)

OTHER PUBLICATIONS

European Extended Search Report dated Jun. 25, 2015 for EP14199007, 6 pages.

*Primary Examiner* — Gene O Crawford
*Assistant Examiner* — Kelvin L Randall, Jr.

(57) ABSTRACT

An article dispensing apparatus capable of dispensing repeatedly the lowest-positioned article from a stack of articles while keeping the second lowest-positioned article in a stable situation is provided. A retainer for retaining the stack of articles is formed in a storing space of a storing section. In a dispensing section for dispensing the lowest-positioned article from the stack through the dispensing opening, a pusher includes an article placement portion on which the remainder of the articles is placed after the lowest-positioned article is dispensed from the stack. During the dispensing operation, the remainder of the articles is received temporarily on the article placement portion of the pusher in such a way that a lowest-positioned article of the remainder (i.e., the second lowest-positioned article in the stack) keeps its ordinary attitude in the storing space.

11 Claims, 22 Drawing Sheets

(56) References Cited

U.S. PATENT DOCUMENTS

| | | | | | |
|---|---|---|---|---|---|
| 2,735,580 | A | * | 2/1956 | Galin et al. | A47F 1/10 221/127 |
| 3,495,738 | A | * | 2/1970 | Alfred | G07F 11/16 221/270 |
| 3,834,582 | A | * | 9/1974 | Aspinwall | B65G 59/067 221/248 |
| 4,702,660 | A | * | 10/1987 | Niehaus | B65G 59/063 221/297 |
| 4,865,222 | A | * | 9/1989 | Sullivan | B65G 59/067 221/241 |
| 5,232,123 | A | * | 8/1993 | Richardson | G07F 11/22 221/155 |
| 5,439,136 | A | * | 8/1995 | Chatani | G07F 11/22 221/258 |
| 2002/0000447 | A1 | | 1/2002 | Tsuchida | |

FOREIGN PATENT DOCUMENTS

| | | |
|---|---|---|
| FR | 2724035 | 3/1996 |
| GB | 929037 | 6/1963 |
| GB | 2166897 | 5/1986 |
| GB | 2326872 | 1/1999 |
| JP | 11236140 | 8/1999 |
| JP | 2001-351165 | 12/2001 |
| JP | 2008-276333 | 11/2008 |
| KR | 950005561 | 5/1995 |

* cited by examiner (Leaf Springs 240a Restraining U-shaped Sliders)

240a
(Leaf Spring Stops Movement of Slider 280 to Lower Pusher 310)

ARTICLE DISPENSING APPARATUS

CROSS-REFERENCE TO RELATED APPLICATION

The present application claims priority from Japanese Application No.: JP2014-115339 filed on Jun. 4, 2014.

BACKGROUND OF THE INVENTION

1. Field of the Invention

The present invention relates to an article dispensing apparatus that dispenses the lowest-positioned article from a stack of articles.

The present invention is applicable to any type of article dispensing apparatuses, such as gaming machines, automatic vending machines, prize or premium dispensing apparatuses and so on if they need the function of dispensing the lowest-positioned article from a stack of articles.

2. Description of Related Art

As the first prior-art technique for the present invention, an automatic discharging apparatus disclosed in Japanese Patent No. 4092452 issued in 2008 is known. This prior-art automatic discharging apparatus comprises a lifting mechanism for lifting box-shaped articles, wherein the box-shaped articles are stored in the form of a stack in an article storing section and wherein the lifting mechanism lifts the articles located at upper positions in the stack than the lowest-positioned article; a slider movable horizontally by way of a rack which is drivably connected to a motor; a pusher for pushing the lowest-positioned article, wherein the pusher is rotatably connected to the rear end of the slider with a pin and is energized toward the articles with a spring.

As the second prior-art technique for the present invention, a commodity dispensing apparatus disclosed in Japanese Patent No. 5109087 issued in 2012 is known. This prior-art commodity dispensing apparatus comprises a pusher for pushing the rear wall of the lowest-positioned one of box-shaped commodities, wherein the box-shaped commodities are stacked in a commodity storing device; a second pusher placed at a position behind the pusher in a direction of pushing the rear wall of the commodity (which will be termed the "pushing direction" below); a movable member having a plate-shaped part that closes the area between the pusher and the second pusher; and a traverse camshaft device for reciprocating the movable member. The pusher, the second pusher and the plate-shaped part are configured in such a way that the plate-shaped part can be moved in conjunction with the reciprocation motion of the movable member to the standby position which is equal to or lower than the height of the lowest-positioned commodity and the pushing position which is equal to or higher than the height of the lowest-positioned commodity.

With the aforementioned prior-art automatic discharging apparatus, the lowest-positioned article is pushed out by the pusher connected to the slider in accordance with the motion of the slider while reducing the weight applied to the lowest-positioned article in the stack of the articles by using the lifting mechanism. However, the second lowest-positioned article is placed on the lowest-positioned article until the push out motion of the lowest-positioned article is completed. Therefore, the attitude of the second lowest-positioned article is not stable at the time when the push out motion of the lowest-positioned article is completed and as a result, there is a problem that the pushing out operation is unable to be maintained because the second lowest-positioned article is turned to an unwanted standing state or the like.

With the aforementioned prior-art commodity dispensing apparatus, the pusher, the second pusher and the plate-shaped part are moved to the pushing position from the standby position in conjunction with the motion of the movable member in the pushing direction. Thus, the lowest-positioned commodity is pushed by the pusher and the second lowest-positioned commodity is raised by the plate-shaped part, thereby sending out the lowest-positioned commodity while keeping the attitude of the second lowest-positioned commodity stable. However, the pusher, the second pusher and the plate-shaped part are moved by using the traverse camshaft device and thus, the pusher, the second pusher and the plate-shaped part are moved to the standby position from the pushing position in accordance with the retreating motion of the movable member. However, the stack of the commodities is moved out of the commodity storing device before completing the motions of the pusher, the second pusher and the plate-shaped part to the standby position from the pushing position. For this reason, the second lowest-positioned commodity which is supported by the plate-shaped part is likely to drop toward the base, resulting in a problem that the attitude of the second lowest-positioned commodity is not stable.

SUMMARY OF THE INVENTION

The present invention was created to solve the aforementioned problems of the first and second prior-art apparatuses.

Accordingly, an object of the present invention is to provide an article dispensing apparatus that makes it possible to dispense repeatedly the lowest-positioned article from a stack of articles while keeping the second lowest-positioned article in a stable situation.

Another object of the present invention is to provide an article dispensing apparatus that surely prevents malfunction of the article dispensing operation of stacked articles one by one.

The above objects together with others not specifically mentioned will become clear to those skilled in the art from the following description.

An article dispensing apparatus according to the present invention comprises:

a storing section for storing a stack of articles in a storing space, wherein a retainer for retaining the stack of articles is formed in the storing space, and a dispensing opening through which a lowest-positioned article is dispensed from the stack in a dispensing direction is formed to communicate with the storing space;

a dispensing section for dispensing the lowest-positioned article from the stack through the dispensing opening, wherein the dispensing section comprises a driving device, a first U-shaped slider which is moved by the driving device, a second U-shaped slider which is moved in conjunction with the first U-shaped slider, and a pusher which is moved in conjunction with the first and second U-shaped sliders; and a controlling section for controlling operation of the driving device of the dispensing section;

wherein the pusher comprises an article placement portion on which a remainder of the articles is placed after the lowest-positioned article is dispensed from the stack;

during a dispensing operation, the pusher pushes forward the lowest-positioned article from its backside, thereby dispensing the lowest-positioned article through the dispensing opening in the dispensing direction, and the pusher receives temporarily a remainder of the articles on the article placement portion in such a way that a lowest-positioned article in the remainder keeps its ordinary attitude in the storing space; and the pusher causes the remainder placed on the article placement portion to be supported by a retainer in the storing section before the pusher retreats from the storing space.

With the article dispensing apparatus according to the present invention, since the retainer for retaining the stack of articles is formed in the storing space of the storing section, not only the stack of the articles can be held within the storing space before the lowest-positioned article is dispensed but also the remainder of the stack can be held in the storing space after the lowest-positioned article is dispensed.

Moreover, the dispensing section comprises the first U-shaped slider_moved by the driving device, the second U-shaped slider moved in conjunction with the first U-shaped slider, and the pusher moved in conjunction with the first and second U-shaped sliders, thereby dispensing the lowest-positioned article from the stack through the dispensing opening. In addition, the pusher of the dispensing section comprises the article placement portion on which the remainder of the articles is placed after the lowest-positioned article is dispensed.

Therefore, during the dispensing operation which is controlled by the controlling section, the remainder of the articles can be received temporarily on the article placement portion of the pusher in such a way that a lowest-positioned article of the remainder (i.e., the second lowest-positioned article in the stack) keeps its ordinary attitude within the storing space.

Accordingly, a lowest-positioned article can be repeatedly dispensed from the stack of the articles while keeping the second lowest-positioned article in a stable situation.

Furthermore, during the dispensing operation, the pusher pushes forward the lowest-positioned article from its back, thereby dispensing the lowest-positioned article through the dispensing opening in the dispensing direction, and the pusher receives temporarily the remainder of the stack on the article placement portion in such a manner that the lowest-positioned article of the remainder of the stack keeps its ordinary attitude in the storing space. Thereafter, the pusher causes the remainder of the stack on the article placement portion, to be supported by a retainer within the storing section before the pusher retreats from the storing space.

Accordingly, the article dispensing operation of the stacked articles one by one is automatically performed without fail. In other words, malfunction of the article dispensing operation of the stacked articles one by one can be surely prevented.

In a preferred embodiment of the article dispensing apparatus according to the present invention, when the pusher pushes the lowest-positioned article from its backside during the dispensing operation, the pusher is moved to a position at which a pushing portion of the pusher is higher than the retainer of the storing section and lower than a top of the lowest-positioned article in height, and then, the pusher starts its pushing operation.

In another preferred embodiment of the article dispensing apparatus according to the present invention, when the pusher causes the remainder placed on the article placement portion to be supported by the retainer of the storing section, the pusher is moved to a position at which the article placement portion of the pusher is lower than the retainer of the storing section in height.

In still another preferred embodiment of the article dispensing apparatus according to the present invention, the pusher is movably connected to the first and second U-shaped sliders_by way of a V-shaped_linking mechanism, wherein due to a reciprocating motion of the first U-shaped slider_by way of the V-shaped linking mechanism, the pusher is moved to a position at which a pushing portion of the pusher is higher than the retainer of the storing section and lower than a top of the lowest-positioned article in height, or a position at which the article placement portion of the pusher is lower than the retainer of the storing section in height.

In a further preferred embodiment of the article dispensing apparatus according to the present invention, the pusher is movably connected to the first and second U-shaped sliders by way of a V-shaped linking mechanism;

wherein the V-shaped linking mechanism comprises V-shaped_link members which are engaged with the pusher and the first and second U-shaped sliders and which have elongated holes, and pins engaged with the elongated holes of the V-shaped link members; and the pusher conducts its operation in conjunction with a reciprocating motion of the first U-shaped slider_by way of the V-shaped linking mechanism.

In this embodiment, it is preferred that the reciprocating motion of the first U-shaped slider is performed by using a combination of a rack gear and a pinion gear. In this case, preferably, the rack gear is connected to the first U-shaped slider, and a remaining portion of the rack gear is received in a tube.

In a further preferred embodiment of the article dispensing apparatus according to the present invention, when the pusher is moved forward to dispense the lowest-positioned article through the dispensing opening, a forward displacement of the remainder is prevented by an inner wall of the storing space.

In a further preferred embodiment of the article dispensing apparatus according to the present invention, a pusher restraining member is provided for moving the pusher to a position at which the article placement portion of the pusher is lower than the retainer of the storing section in height when the pusher causes the remainder of the stack on the article placement portion to be supported by the retainer.

In this embodiment, it is preferred that the pusher restraining member is a flap-like member rockably mounted on a horizontal shaft fixed in the storing section; wherein the flap-like member is rockable in a forward direction but is not rockable in a backward direction, thereby allowing the pusher to move forward and restraining the pusher from moving backward.

Alternately, in this embodiment, it is preferred that the pusher restraining member is a leaf spring fixed in the dispensing section in such a way that the second U-shaped slider_abuts on the leaf spring; wherein by setting a force for moving the second U-shaped slider backward applied from the driving device not to exceed a predetermined value, the second U-shaped slider_is restrained from passing over the leaf spring, thereby restraining the pusher from moving backward.

In a further preferred embodiment of the article dispensing apparatus according to the present invention, a base for supporting the first and second U-shaped sliders_and the pusher is further provided; wherein the base comprises a first guide for guiding the first U-shaped slider, and a second guide for guiding the second U-shaped slider; and the first U-shaped slider is moved reciprocally by a driving device along the first guide, the second U-shaped slider is moved reciprocally by the first U-shaped slider_along the second guide, the pusher is movably placed on the second U-shaped slider_and is moved reciprocally by the first U-shaped slider by way of a V-shaped_link mechanism.

In this embodiment, it is preferred that the first guide is provided on a back of the base, and the second guide is provided on a surface of the base; wherein the first U-shaped slider is moved reciprocally by way of a combination of a rack gear and a pinion gear, and the second U-shaped slider is moved reciprocally by way of pins which are engaged with elongated holes of the second U-shaped slider.

In addition, in this embodiment, it is preferred that the V-shaped_link mechanism comprises pins supported commonly by the first and second U-shaped sliders_in such a way that the first and second U-shaped sliders are relatively movable, first rocking shafts are provided on the second U-shaped slider_in such a way that the second U-shaped slider and the pusher are relatively movable, second rocking shafts are provided on the pusher in such a way that the second movable member and the pusher are relatively movable, and V-shaped link members are provided at each side of the pusher and having elongate holes; wherein the pins and the first rocking shafts are rockably engaged with the elongate holes of the V-shaped link members, so that the pusher is not only reciprocally moved along the dispensing direction but also rockably moved around the pins.

In a further preferred embodiment of the article dispensing apparatus according to the present invention, a pair of sidewalls which are apart from each other at a predetermined interval, and a base for supporting the first and second U-shaped sliders_and the pusher are further provided; wherein the pair of sidewalls are located below the storing space, and the base is located between the pair of sidewalls; and wherein the base comprises a first guide for guiding the first U-shaped slider, and a second guide for guiding the second U-shaped slider; whereby the first U-shaped slider is moved reciprocally by a driving device along the first guide, the second U-shaped slider is moved reciprocally by the first U-shaped slider_along the second guide, and the pusher is movably placed on the second U-shaped slider and is moved reciprocally by the first U-shaped slider by way of a V-shaped linking mechanism.

In a further preferred embodiment of the article dispensing apparatus according to the present invention, when the pusher pushes the lowest-positioned article from its backside during the dispensing operation, the pusher is moved upward in response to a forward motion of the first U-shaped slider, thereby enabling a pushing portion of the pusher to push the lowest-positioned article toward the dispensing opening; and the pusher is moved downward in response to a backward motion of the first U-shaped slider, thereby causing the remainder of the stack placed on the article placement portion to be supported by the retainer of the storing section.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
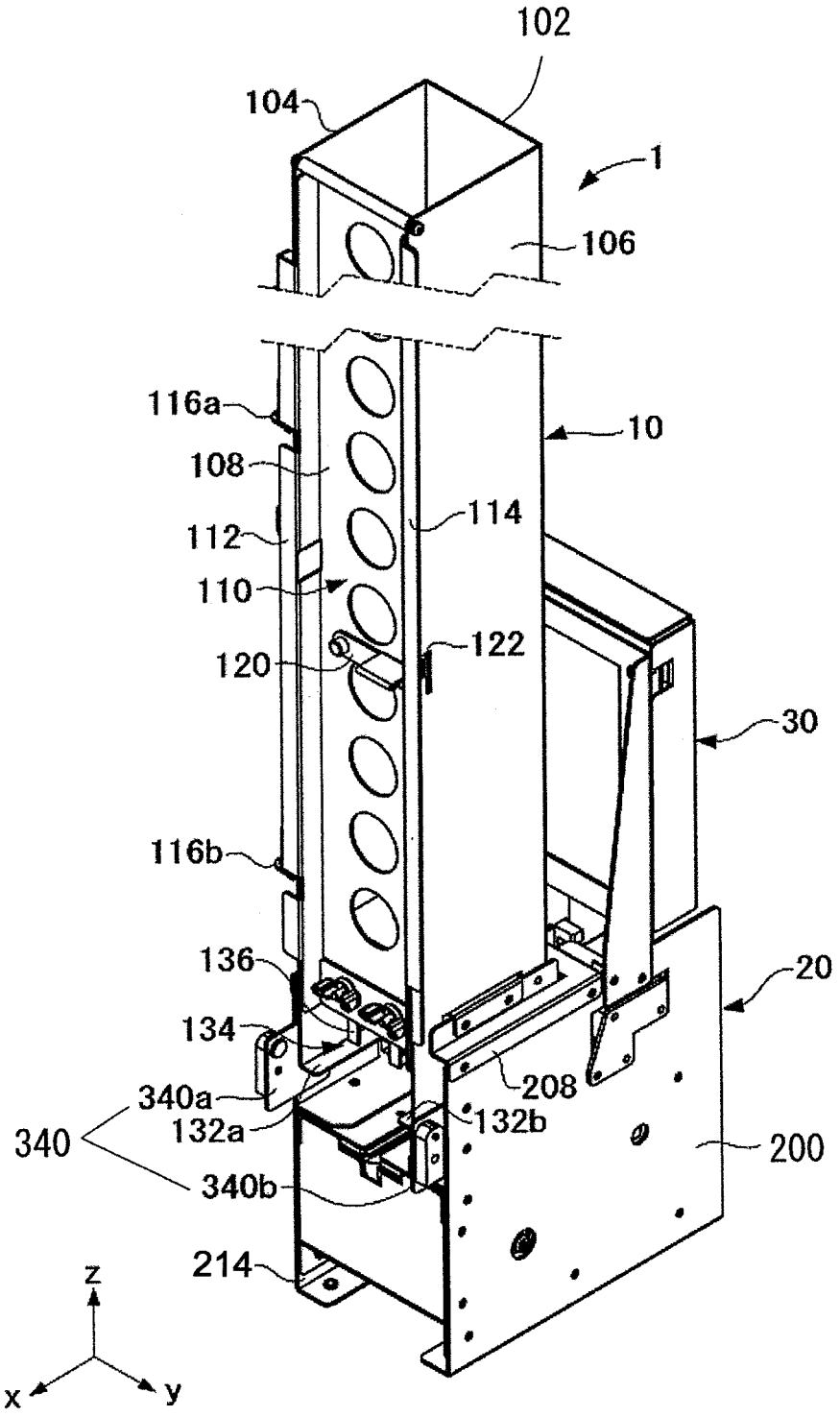
FIG. 1 is a schematic perspective view of an article dispensing apparatus according to a first embodiment of the present invention, in which the article storing section is partially cut away.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Preferred embodiments of the present invention will be described in detail below while referring to the drawings attached.

In this specification, an "article" M has a wide meaning, which can include, for example, a box-shaped article in which food, an article, a card, cigarettes or the like is/are enclosed, a sheet-like bag in which a card, paper or the like is enclosed, a thin plate-shaped article in which a compact disk (CD) or a digital versatile disk (DVD) is enclosed, and a sheaf containing wrapped cards, sheets or the like. Any type of article is included in the term "article" M, if it can be stacked approximately vertically to form a stack and can be moved approximately horizontally by a pushing operation from the stack one by one.

First Embodiment

An article dispensing apparatus 1 according to the first embodiment of the present invention has the function of dispensing articles M one by one. The articles M can be box-shaped and stacked to form a stack. One of the articles M which is located at the lowest position of the stack (i.e., the lowest-positioned article M) is dispensed by pushing the rear face of the lowest-positioned article M horizontally.

As shown in FIGS. 1 to 4, the article dispensing apparatus 1 comprises a storing section 10 for storing a stack of the articles M, a dispensing section 20 for dispensing the articles M one by one by pushing the same, and a controlling section 30 for controlling the operation of the dispensing section 20.

In this specification, as shown in FIG. 1, the direction along which the articles M are stacked in the storing section 10 (i.e., the vertical direction) is defined as the z axis, the direction along which the article M is dispensed from the storing section 10 and which is perpendicular to the z axis (i.e., a horizontal direction) is defined as the x axis, and the direction perpendicular to the x axis and z axis (i.e., another horizontal direction) is defined as the y axis. The dispensing direction of the articles M is parallel to the x axis.

Moreover, the direction of +z is defined as the upward direction along the z axis, and the direction of −z is defined as the downward direction along the z axis. If a plurality of articles M are stacked upward, it may be said that the articles M are stacked in the direction of +z. If an article M is moved downward, it may be said that the article M is moved in the direction of −z.

Similarly, the direction of +x is defined as the forward direction (i.e., the leftward direction in FIG. 9) along the x axis, and the direction of −x is defined as the backward direction (i.e., the rightward direction in FIG. 9) along the x axis. If a pusher is moved forward, it may be said that the pusher is moved in the direction of +x. If a pusher is moved backward, it may be said that the pusher is moved in the direction of −x.

[Storing Section]

First, the storing section 10 is explained below with reference to FIGS. 1 to 6.

The storing section 10 has the function of storing a plurality of articles M in the form of a stack in the storing space. The storing section 10 is extended along the z axis and has a cylindrical shape with a rectangular cross section perpendicular to the z axis. This cross section is slightly larger than the top surface of an article M on which another article M is stacked.

More specifically, the storing section 10 comprises a first wall 102 that supports the rear wall of an article M, second and third walls 104 and 106 that protrude respectively so as to be perpendicular to the first wall 102 from the two sides of the first wall 102 which are parallel to the z axis, and a fourth wall 108 located to be opposed to the first wall 102, thereby forming a columnar shape with a rectangular cross section perpendicular to the z axis. Thus, the storing space of the storing section 10 is a rectangular columnar shape.

In this first embodiment, the first to third walls 102, 104 and 106 are formed integrally in such a way that a cross section perpendicular to the z axis is like a U character. The fourth wall 108 is bent to form a groove, thereby forming an elongated protruding part 110 and first and second strip-shaped wing parts 112 and 114 which are located at each side of the protruding part 110. The protruding part 110 extends along the z axis and protrudes inwardly toward the first wall 102 along the x axis. The first and second wing parts 112 and 114 extend along the z axis and protrude respectively along the y axis in opposite directions from the two side edges of the protruding part 110. The width of the protruding part 110 along the y axis is set to be slightly smaller than the distance between the second and third walls 104 and 106 so that the protruding part 110 may be inserted inward to extend between the second and third walls 104 and 106.

The fourth wall 108 is rockably connected to the second wall 104 with first and second hinge members 116*a* and 116*b*. The first and second hinge members 116*a* and 116*b* are provided on the side portion of the second wall 104 which is formed on the opposite side of the first wall 102 and on the first wing part 112 of the fourth wall 108 which is formed on the side of the second wall 104.

The protruding part 110 of the fourth wall 108 has an approximately rectangular hole (not shown in FIG. 1) which is formed at a predetermined position on the peripheral area of the protruding part 110 which is formed on the side of the third wall 106. The third wall 106 has an approximately rectangular engaging hole 122 which is formed at a position opposite to the hole of the protruding part 110. On the outer surface of the protruding part 110 which is formed on the opposite side to the first wall 102, a locking member 120 for locking the rocking motion of the fourth wall 108 is provided. The locking member 120 is located at a corresponding position to the engaging hole 122.

Needless to say, the open/close mechanism of the fourth wall 108 is not limited to this shape and any other appropriate mechanism may be used for this purpose. For example, a hinge mechanism comprising bearings provided on the second wall 104 and bearings provided on the fourth wall 108 can be alternately arranged and used. In this case, a shaft is penetrated through these bearings, thereby enabling the fourth wall 108 to be rockable around this shaft. In addition, the fourth wall 108 may be configured to be slidable with respect to the second and third walls 104 and 106, thereby enabling the fourth wall 108 to be detachable by a sliding movement from the second and third walls 104 and 106.

Figure 2:
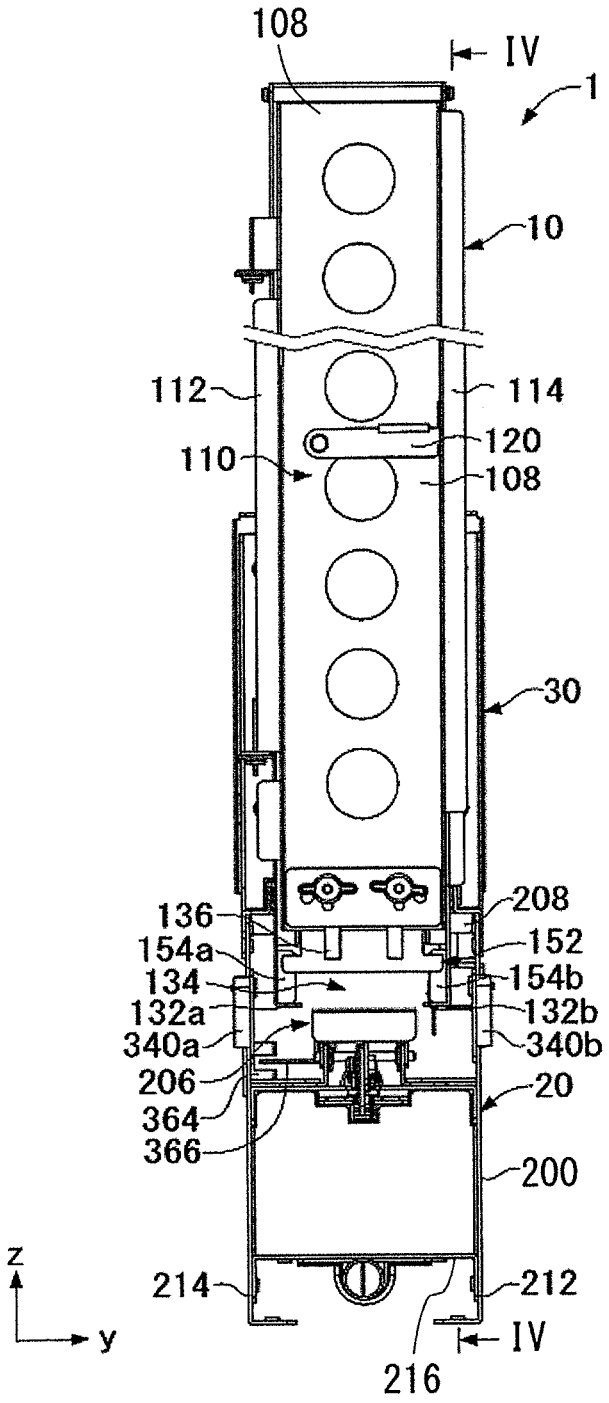
FIG. 2 is a front view of the article dispensing apparatus according to the first embodiment of FIG. 1, in which the storing section is partially cut away.

On the lower ends of the second and third walls 104 and 106, a pair of retaining parts (in other words, retainers) 132*a* and 132*b* are formed respectively to be opposite to each other, See FIGS. 1 and 2. The first retaining part 132*a* is a rectangular plate-shaped part extending inwardly along the y axis toward the third wall 106, which is positioned at the lowest end of the second wall 104. Similarly, the second retaining part 132*b* is a rectangular plate-shaped part extending inwardly along the y axis toward the second wall 104, which is positioned at the lowest end of the third wall 106. Therefore, the first and second retaining parts 132*a* and 132*b* are perpendicular to the second and third walls 104 and 106 in the storing space. The first and second retaining parts 132*a* and 132*b* have the function of retaining the stack of articles M stored in the storing space.

The first and fourth walls 102 and 108 are formed to be shorter than the lengths of the second and third walls 104 and 106 along the z axis in such a way that the lower ends of the first and fourth walls 102 and 108 are located at upper positions than those of the first and second retaining parts 132*a* and 132*b*. The distance of the lower ends of the first and fourth walls 102 and 108 from the first and second retaining parts 132*a* and 132*b* is set to be equal to or greater than the height (or thickness) of one article M and less than the height (or thickness) of the stack of two articles M.

If the distance between the lower ends of the first and fourth walls 102 and 108 and the first and second retaining parts 132*a* and 132*b* is defined as D, and the height of each article M is defined as Ha, it may be said that D and Ha are satisfied with the relationship of $Ha \leq D < 2Ha$.

Here, an article M located at the lowest position in an article stack is referred to as M1, and an article M stacked on the lowest-positioned article M1 is referred to as M2. Due to such the configuration as described above, even if the lowest-positioned article M1 of the stack in the storing space is moved along the x axis to the outside of the storing section 10, the movement of the second lowest-positioned article M2 in the stack along the x axis is restrained by the first and fourth walls 102 and 108 thereby defining the storing space of the storing section 10 and as a result, the article M2 is held within the storing space.

In this first embodiment, the distance D between the lower ends of the first and fourth walls 102 and 108 and the first and second retaining parts 132*a* and 132*b* and the height Ha of each article M are satisfied with the relationship of $Ha \leq D < 2Ha$. However, the present invention is not limited to this configuration. For example, instead of making the first and fourth walls 102 and 108 shorter than the second and third walls 104 and 106, appropriate retaining members with high rigidity may be fixed respectively to the lower ends of the second and third walls 104 and 106 in such a way that the lower ends of first and fourth walls 102 and 108 are located at upper positions than those of the rigid retaining members thus fixed while satisfying the aforementioned relationship of $Ha \leq D < 2Ha$. In this structure, simply by replacing the rigid retaining members or changing the fixing positions of the rigid retaining members to the second and third walls 104 and 106, the article dispensing apparatus 1 of the first embodiment can be applied to any other article whose height along the z axis is different.

Between the lower end of the fourth wall 108 and the first and second retaining parts 132*a* and 132*b*, a dispensing opening 134 is formed below the lower end of the fourth wall 108. A front stopper 136 having a shape like comb teeth is formed at the lower end of the fourth wall 108 so as to protrude downward into the dispensing opening 134. The front stopper 136 is flexible enough for supporting the self-weight of an article M without flexure. Here, the front stopper 136 is formed by a flat plate made of a synthetic resin.

The front stopper 136 has the following function. Specifically, in the case where the lowest-positioned article M1 is not pushed by an operation of the dispensing section 20, the front stopper 136 is not deformed and the motion of the lowest-positioned article M1 along the x axis is restrained by the front stopper 136 and held in the storing space. On the other hand, in the case where the lowest-positioned article M1 is pushed by the operation of the dispensing section 20, the front stopper 136 is pushed by the article M1 and deformed, thereby allowing the article M1 to pass through the dispensing opening 134 along the x axis.

The structure of the front stopper 136 is not limited to this example. It is sufficient for the present invention that the front stopper 136 has a flexibility. The front stopper 136 may be formed by a member with a flexibility, such as a thin plate made of metal, a member made of spring material and so on. Moreover, it is sufficient for the front stopper 136 to hold the lowest-positioned article M1 in the storing section 10 and to prevent the article M1 from being sent out to the outside. The number of the contact points of the front stopper 136 to the article M1 may be one or more. A movable shutter configured to be operated in conjunction with the operation of the dispensing section 20 may also be used as the front stopper 136.

Figure 5:
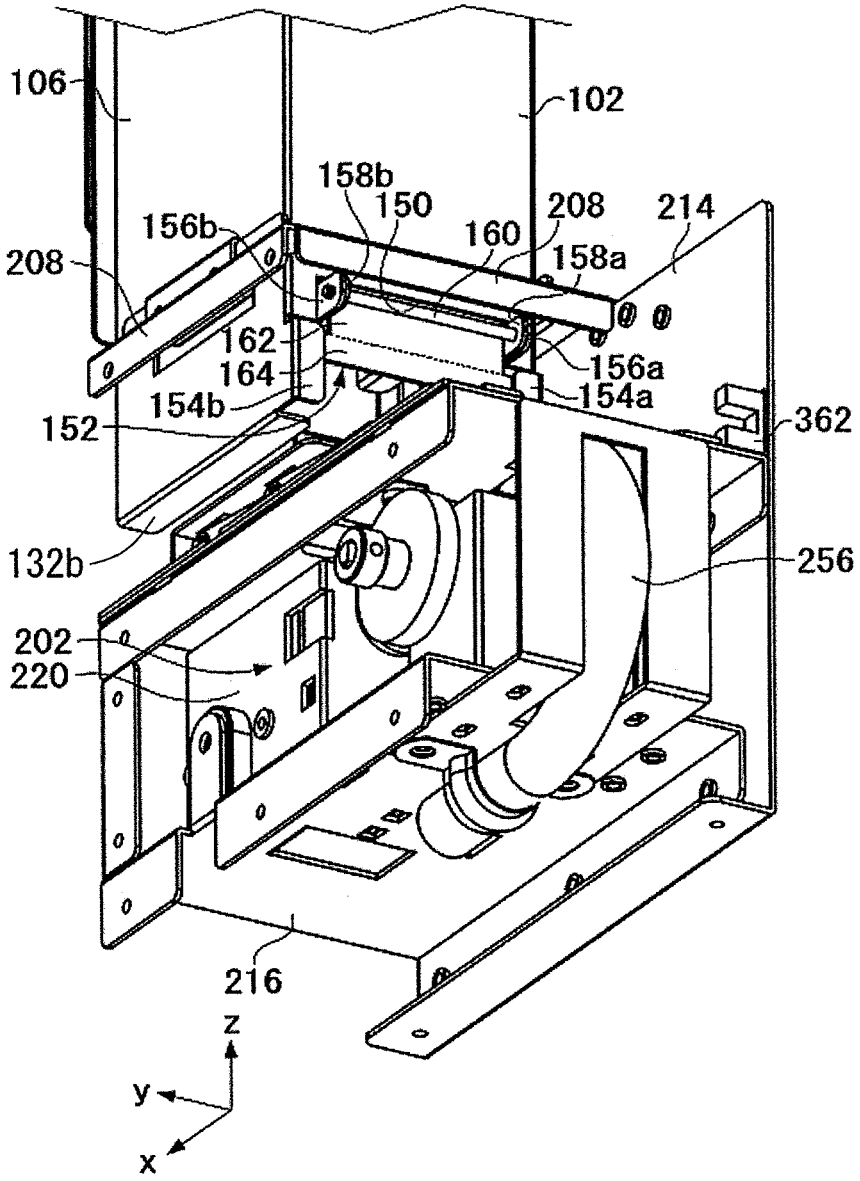
FIG. 5 is a partial perspective view showing the structure of the lower part of the storing section and the dispensing section of the article dispensing apparatus according to the first embodiment of FIG. 1.

As shown in FIG. 5, the lower end of the first wall 102 is partially cut away, forming a cutout portion 150 with an approximately U-like shape. A flap 152 is rockably provided in the cutout portion 150. A pair of bearings 156*a* and 156*b* is fixed to the lower end of the first wall 102 so as to protrude backward respectively from predetermined positions arranged near the second and third walls 104 and 106 along the x axis, i.e., in the direction of −x. The bearings 156*a* and 156*b* are positioned at both sides of the cutout portion 150, respectively. A shaft 160 is installed to bridge the interval between the bearings 156*a* and 156*b*. A pair of rear stoppers 154*a* and 154*b* are respectively formed on the second and third walls 104 and 106 so as to protrude toward the third and second walls 106 and 104. The rear stoppers 154*a* and 154*b* are located at predetermined positions below the lower end of the first wall 102, in other words, between the lower end of the first wall 102 and the first and second retaining parts 132*a* and 132*b*.

The flap 152 comprises a first rectangular part 162 whose length along the y axis is relatively shorter and a second rectangular part 164 whose length along the y axis is relatively longer, thereby forming a two-stepped shape. The width along the y axis of the first rectangular part 162 is set to be shorter than the interval between the pair of first bearings 156*a* and 156*b* along the y axis. The width along the y axis of the second rectangular part 164 is set to be shorter than the interval along the y axis between the second and third walls 104 and 106 and longer than the interval along the y axis between the pair of rear stoppers 154*a* and 154*b*. A pair of bearings 158*a* and 158*b* are formed on both sides of the first rectangular part 162 along the y-axis, respectively. The pair of bearings 158*a* and 158*b* formed on the flap 152 are located between the pair of bearings 156*a* and 156*b* formed on the second and third walls 104 and 106, and are rotatably engaged with the shaft 160.

In this way, the second rectangular part 164 of the flap 152 is located closer to the fourth wall 108, in other words, located more to the front along the x axis, with respect to the pair of the rear stoppers 154*a* and 154*b*. The flap 152 can be rocked forward and backward along the x axis around the shaft 160. The rocking motion of the flap 150 from a drooping state toward the back, i.e., in the direction of −x, is restrained by the pair of rear stoppers 154*a* and 154*b*.

[Dispensing Section]

Next, the dispensing section 20 will be explained below with reference to FIGS. 2 to 8.

The dispensing section 20 is disposed below the storing section 10 and has a function of dispensing the lowest-positioned article M from a stack of articles M stored in the storing section 10 by a pushing movement on an article M. The dispensing section 20 comprises a base subsection 200, a driving subsection 202, a base 204, and a pushing subsection 206. The driving subsection 202 is provided in the base subsection 200. The base 204 is placed on the upper part of the driving subsection 202. The pushing subsection 206 is slidable forward and backward on the base 204 along the x axis and pushes an article M stored in the storing section 10 to dispense the same.

As shown in FIGS. 2 to 6, the base subsection 200 comprises first and second sidewalls 212 and 214 and a bottom plate 216. The first and second sidewalls 212 and 214 are extended vertically (i.e., along the z axis) and opposite to each other horizontally (i.e., along the y axis). A bottom plate 216 is located between the first and second sidewalls 212 and 214 and fixed so as to interconnect the lower parts of the sidewalls 212 and 214. The first and second sidewalls 212 and 214 and the bottom plate 216 constitutes a structure whose cross-sectional shape is like an H character. The storing section 10 is fixed to the upper parts of the first and second sidewalls 212 and 214. In this first embodiment, the storing section 10 is fixed to the first and second sidewalls 212 and 214 by way of jigs 208, see FIGS. 2 and 5, which are fixed to the base subsection 200. A hollow tube 256 for receiving the back part of a rack gear (which will be described later) is provided in the rear portion of the base subsection 200 in such a way as to be bent to have a U-like shape. One end of the tube 256 is fixed to the base 204 and the other end thereof is fixed to the back side of the bottom plate 216.

Figure 4:
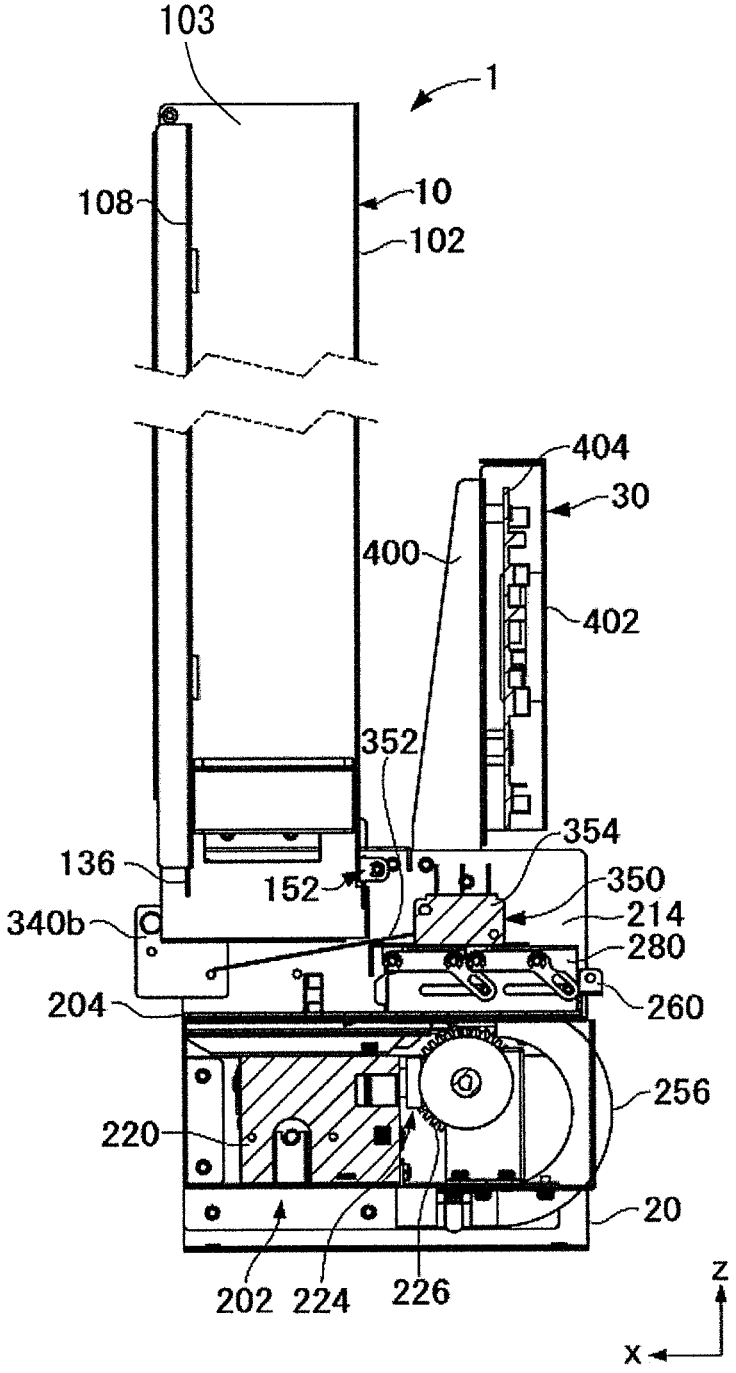
FIG. 4 is a cross-sectional view along the line IV-IV in FIG. 2.
Figure 6:
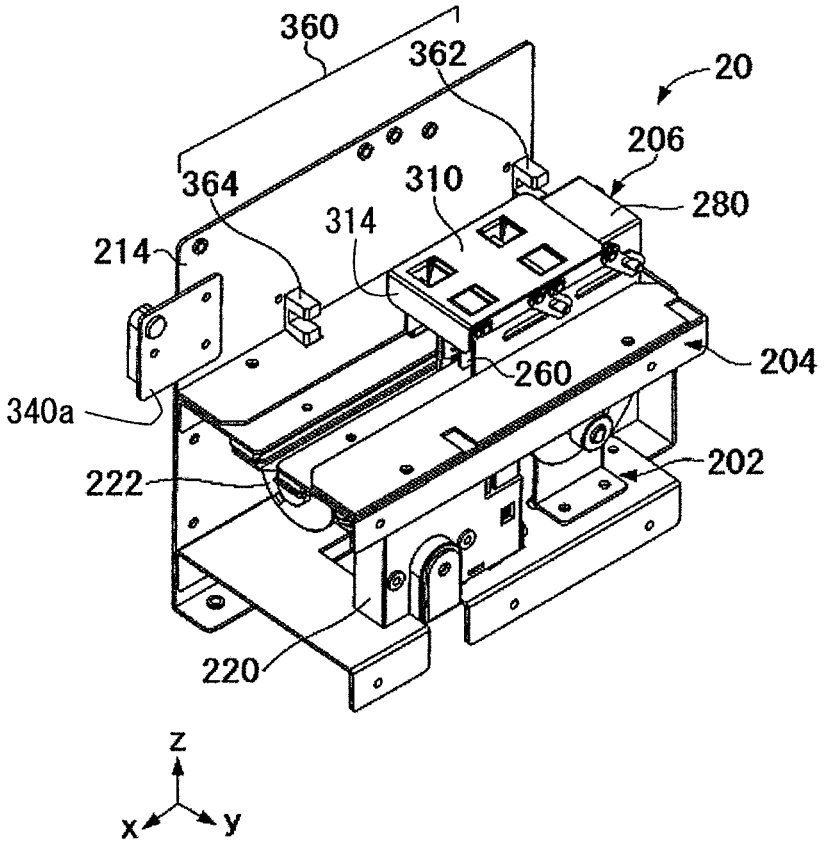
FIG. 6 is a perspective view showing the structure of the pushing subsection of the dispensing section of the article dispensing apparatus according to the first embodiment of FIG. 1.

The driving subsection 202 has a structure shown in FIGS. 4 to 6. The driving subsection 202, which drives the dispensing section 20, is placed on the bottom plate 216. The driving subsection 202 comprises a case 220, a motor 222, a speed reducer 224, and a pinion gear 226. The case 220 is fixed onto the bottom plate 216. The motor 222 and the speed reducer 224 which is connected to the output shaft of the motor 222 are placed in the case 220. The pinion gear 226 is drivably connected to the speed reducer 224 and is engaged with a rack gear 252 of the pushing subsection 206. In this way, the driving power of the motor 222 is transmitted to a rack gear 252.

The motor 222 (which corresponds to a driving device) is placed below the storing section 10. The output shaft of the motor 222 is directed toward the back of the article dispensing apparatus 1, in other words, in the direction of −x. The output shaft of the motor 222 is connected to the speed reducer 224. The pinion gear 226, the rotational axis of which is set to be parallel to the y axis, is connected to the speed reducer 224 on the opposite side to the motor 222 with respect to the speed reducer 224.

Figure 7:
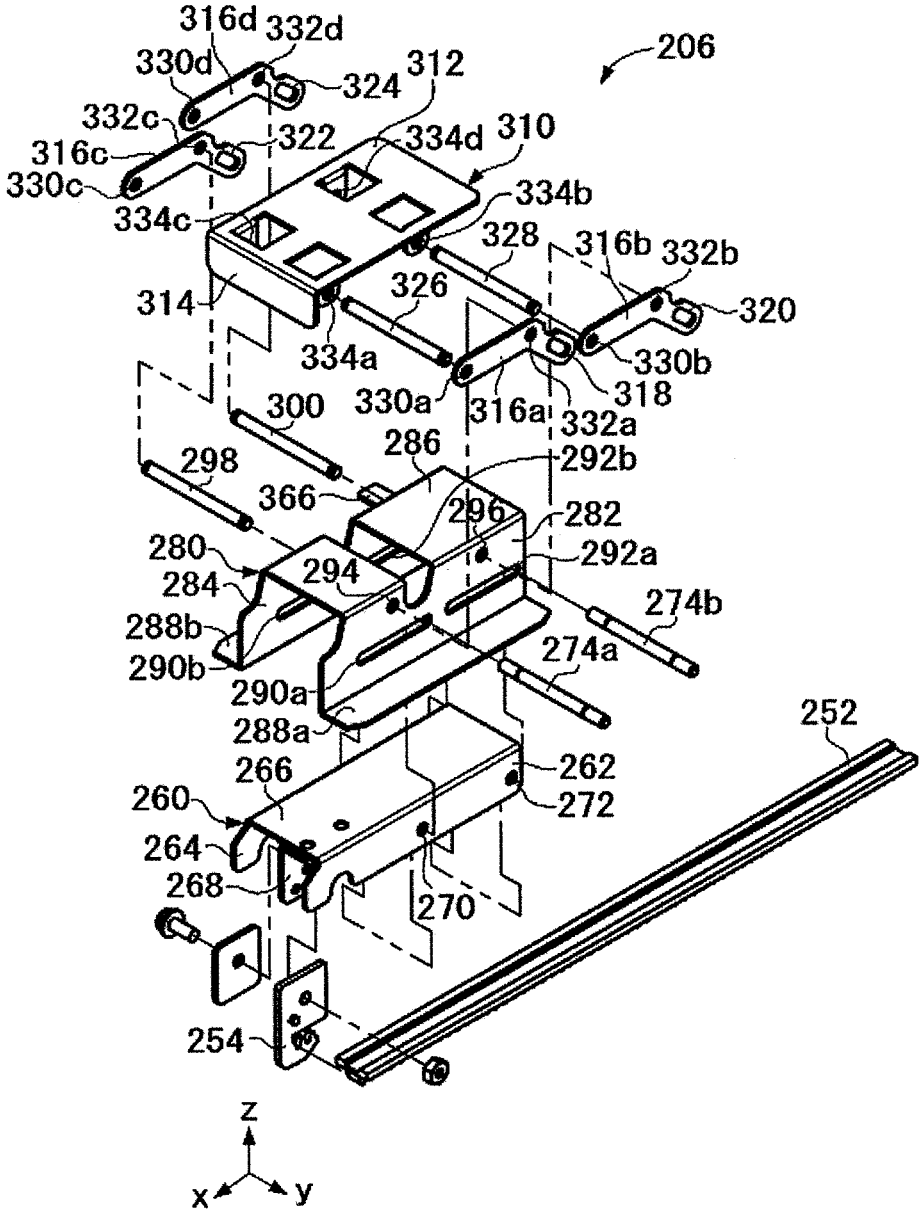
FIG. 7 is an exploded perspective view showing the structure of the pushing subsection of the dispensing section of the article dispensing apparatus according to the first embodiment of FIG. 1.

The pushing subsection 206 has a structure shown in FIGS. 6 and 7. The pushing subsection 206 comprises the rack gear 252, first and second sliders as first and second U-shaped sliders 260 and 280, and a pusher 310 with article support placement portion 312. The rack gear 252 is drivably connected to the motor 222 by way of the speed reducer 224 and the pinion gear 226, and converts the rotational motion of the motor 222 to the linear motion of the rack gear 252. The rack gear 252 is slidable in a forward and backward movement along the x axis in accordance with the rotational direction of the motor 222. Each of the first and second U-shaped sliders 260 and 280 are slidable forward and backward along the x axis in conjunction with the sliding motion of the rack gear 252. The pusher 310 is connected to the second U-shaped slider 280 by way of V-shaped link members 316*a*, 316*b*, 316*c* and 316*d* which collectively form a V-shaped linking mechanism.

The second U-shaped_slider 280 is configured in such a way as to be slidable along the x axis between a first standby position SP1 and a first dispensing position MP1. The first standby position SP1 is set at a position which is shifted backward from the storing section 10 along the x axis. The first dispensing position MP1 is at a position at which the lowest-positioned article M1 is to be dispensed.

Figure 11:
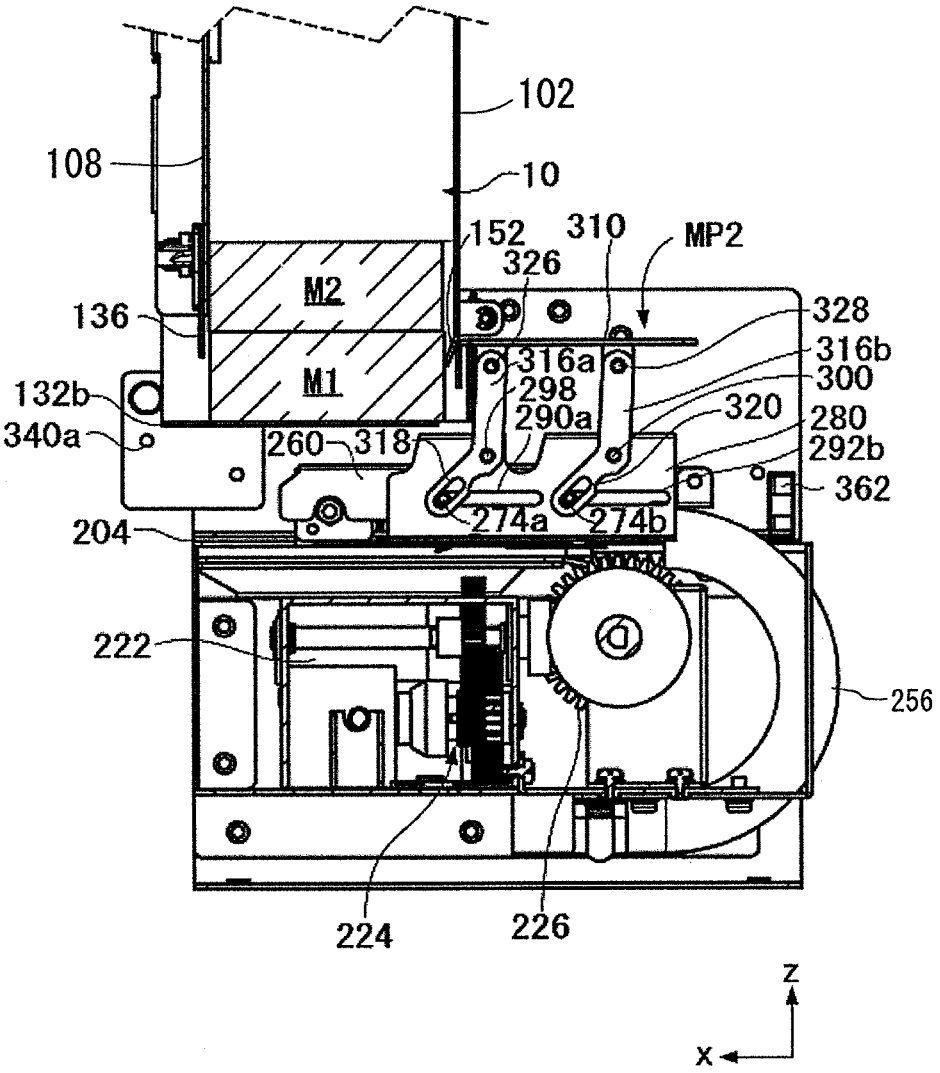
FIG. 11 is a cross-sectional side view showing the dispensing operation of the article dispensing apparatus according to the first embodiment of FIG. 1, in which the pushing subsection is moved forward into the storing section.
Figure 16:
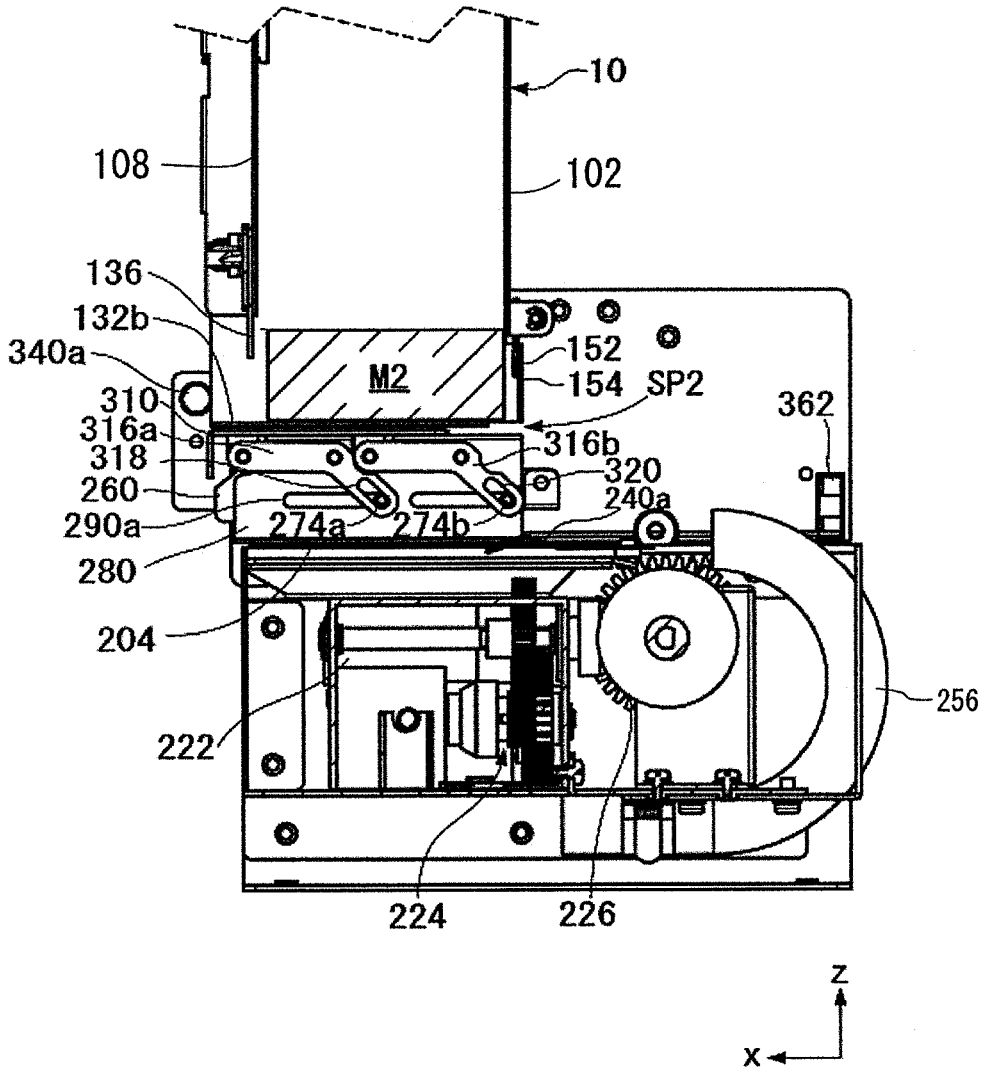
FIG. 16 is a cross-sectional side view showing the dispensing operation of the article dispensing apparatus according to the first embodiment of FIG. 1, in which the pusher is moved to the standby position.

The pusher 310 is configured in such a way as to be movable between a second standby position SP2 and a second dispensing position MP2, see FIG. 16 and FIG. 11. The second standby position SP2 is set at a position which is lower along the z axis than the bottom face of the lowest-positioned article M1 held by the first and second retaining parts 132*a* and 132*b*. The second dispensing position MP2 is set at a position between the bottom and top faces of the lowest-positioned article M1 held by the first and second retaining parts 132*a* and 132*b*.

The rack gear 252 is configured as follows. The rack gear 252 is placed in such a way that the tooth part of the gear 252 is faced to the driving subsection 202, i.e. faced in the downward direction. The tooth part of the rack gear 252 is drivably connected to the tooth part of the pinion gear 226. In this way, the driving power of the motor 222 is transmitted to the rack gear 252 by way of the speed reducer 224 and the pinion gear 226. Because of the drivable connection of the pinion and rack gears 226 and 252, the rotational motion of the motor 22 is converted to the linear motion of the first slider 260. The rack gear 252 is made of a material with flexibility. One end of the rack gear 252 is fixed to the first U-shaped slider 260 by way of a connecting member 254 and the other end thereof is bent and inserted into the tube 256.

The mechanism for converting the rotational motion of the motor 222 to the linear motion of the first U-shaped-_slider 260 is not limited to a combination of the pinion and rack gears 226 and 252 as used in this first embodiment. The pinion gear 226 may be replaced with a worm gear, forming a combination of the worm gear and a rack gear. The pinion gear 226 and the rack gear 252 may be respectively replaced with two worm gears, forming a combination of a worm gear and another worm gear. Any other combination of gears may be used for this purpose if it can convert the rotational motion of the motor 222 to the linear motion of the first U-shaped_slider 260. In addition, the linear reciprocating motion, i.e., the sliding motion, of the first U-shaped slider 260 may be caused by a belt, a chain, a traverse camshaft and so on.

The connecting member 254 comprises a rectangular flat plate portion and an L-like hook portion, which are formed to be included in the same plane, as shown in FIG. 7. The connecting member 254 is configured to be able to sandwich the rack gear 252 by the opposite inner faces of the flat plate portion and the hook portion. On the inner face of the hook portion of the connecting member 254 opposite to the flat plate portion thereof, a tooth part having the same shape as the tooth part of the rack gear 252 is formed. The tooth part of the hook portion is engaged with the tooth part of the rack gear 252. For this reason, there is no possibility that the connecting member 252 is detached from the rack gear 252 during the sliding motion of the rack gear 252.

The first U-shaped_slider 260 is drivably connected to the rack gear 252 by way of the connecting member 254 and further, is drivably connected to the second U-shaped_slider 280 and the pusher 310 by way of first and second pins 274*a* and 274*b*. The first U-shaped_slider 260 is slidable forward and backward on the base 204 along the x axis in conjunction with the sliding motion of the rack gear 252, thereby driving the second U-shaped_slider 280 and the pusher 310. The first U-shaped_slider 260 comprises a U-like shape in a cross section parallel to the y axis. The front and rear ends and the bottom of the first U-shaped_slider 260 are opened. The first U-shaped 260 has first and second sidewalls 262 and 264 and a top wall 266 that interconnects the first and second sidewalls 262 and 264. The opened bottom (i.e., the depressed portion) of the first U-shaped slider 260 is opposed to the rack gear 252. At the front end of the first U-shaped slider 260 along the x axis, a connected member 268 is provided. The connected member 268 is formed by a plate-shaped material which is formed to have an L-like shape. One end of the connected member 268 is fixed to the back side of the top wall 266 and the other end thereof is connected to the connecting member 254. The connected member 268 is not limited to this embodiment. A member with a T-like shape may be used as the connected member 268. The connecting member 253 and the connected member 268 may be formed integrally. The connected member 268 may be formed by bending a part of the top wall 266 toward its back side.

On the first sidewall 262 of the first U-shaped slider 260, a circular first through hole 270 is formed at an approximately central part along the x axis and a circular second through hole 272 is formed at the rear end part along the x axis. The first and second through holes 270 and 272 are located at the same height along the z axis, in other words, on the same straight line along the x axis. Similarly, on the second sidewall 264 of the first U-shaped slider 260, a circular first through hole 270 is formed at a corresponding position to the first through hole 270 of the first sidewall 262 and a circular second through hole 272 is formed at a corresponding position to the second through hole 272 of the first sidewall 262. A first pin 274*a* is inserted into the first through holes 270 of the first and second sidewalls 262 and 264. A second pin 274*a* is inserted into the second through holes 272 of the first and second sidewalls 262 and 264. The first and second pins 274*a* and 274*b* are extended along the y axis, which are perpendicular to the longitudinal axis (i.e., the x axis) of the first U-shaped slider 260.

The second U-shaped slider 280 has a cross section like a hat with a brim along the y axis. The front and rear ends and the bottom of the second U-shaped slider 280 are opened. The second U-shaped slider 280 comprises first and second sidewalls 282 and 284 extending along the z axis to be opposite to each other, a top wall 286 interconnecting the first and second sidewalls 282 and 284 and extending along the y axis, a brim portion 288*a* protruding from the lower end of the first sidewall 282 in the direction of +y, and a brim portion 288*b* protruding from the lower end of the second sidewall 284 in the direction of −y.

The interval between the first and second sidewalls 282 and 284 along the y axis is set to be larger than the width of the first U-shaped_slider 260. The first U-shaped slider 260 is inserted into the inside (that is, the hat-shaped depression) of the second slider U-shaped slider 280, which is formed by the first and second sidewalls 282 and 284 and the top wall 286.

On the first sidewall 282 of the second U-shaped slider_280, first and second elongated holes 290*a* and 292*a* are formed to extend along the x axis, and in addition, a first circular through hole 294 is formed at a position above the first elongated hole 290*a* and a second circular through hole 296 is formed at a position above the second elongated hole 292*a*. Similarly, on the second sidewall 284 of the second U-shaped slider 280, first and second elongated holes 290*b* and 292*b* are formed to extend along the x axis, and in addition, a first circular through hole 294 is formed at a position above the first elongated hole 290*b* and a second circular through hole 296 is formed at a position above the second elongated hole 292*b*.

One end of the first pin 274*a* is inserted into the first elongated hole 290*a* on the first sidewall 282 and the other end thereof is inserted into the first elongated hole 290*b* on the second sidewall 284, see FIG. 7. One end of the second pin 274*b* is inserted into the second elongated hole 292*a* on the first sidewall 282 and the other end thereof is inserted into the second elongated hole 292*b* on the second sidewall 284.

One end of a rocking shaft 298 is inserted into the first through hole 294 on the first sidewall 282 and the other end of the rocking shaft 298 is inserted into the first through hole 294 on the second sidewall 284. One end of a rocking shaft 300 is inserted into the second through hole 296 on the first sidewall 282 and the other end of the rocking shaft 300 is inserted into the second through hole 296 on the second sidewall 284.

Each of the link members 316*a*, 316*b*, 316*c* and 316*d* is formed by an elongated flat plate whose shape is like a V character. The V-shaped link member 316*a* comprises a first shaft hole 330*a* formed at the front end, a second shaft hole 332*a* formed at the bending portion, and an elongated hole 318 formed at the rear end opposite to the front end. The V-shaped link member 316*b* comprises a first shaft hole 330*b* formed at the front end, a second shaft hole 332*b* formed at the bending portion, and an elongated hole 320 formed at the rear end opposite to the front end. The V-shaped link member 316*c* comprises a first shaft hole 330*c* formed at the front end, a second shaft hole 332*c* formed at the bending portion, and an elongated hole 322 formed at the rear end opposite to the front end. The V-shaped link member 316*d* comprises a first shaft hole 330*d* formed at the front end, a second shaft hole 332*d* formed at the bending portion, and an elongated hole 324 formed at the rear end opposite to the front end. The link members 316*a* and 316*b* are arranged along the x axis on the side of the first sidewall 282 of the second U-shaped slider 280. The link members 316*c* and 316*d* are arranged along the x axis on the side of the second sidewall 284 of the second U-shaped slider 280.

One end of a rocking shaft 326 is inserted into the first shaft hole 330*a* of the link member 316*a* and the other end of the rocking shaft 326 is inserted into the first shaft hole 330*c* of the link member 316*c*.

One end of the rocking shaft 298 is inserted into the second shaft hole 332*a* of the link member 316*a* and the other end of the rocking shaft 298 is inserted into the second shaft hole 332*c* of the link member 316*c*. One end of the first pin 274*a* is inserted into the elongated hole 318 of the link member 316*a* and the other end of the first pin 274*a* is inserted into the elongated hole 322 of the link member 316*c*. One end of the rocking shaft 328 is inserted into the first shaft hole 330*b* of the link member 316*b* and the other end of the rocking shaft 328 is inserted into the first shaft hole 330*d* of the link member 316*d*. One end of the rocking shaft 300 is inserted into the second shaft hole 332*b* of the link member 316*b* and the other end of the rocking shaft 300 is inserted into the second shaft hole 332*d* of the link member 316*d*. One end of the second pin 274*b* is inserted into the elongated hole 320 of the link member 316*b* and the other end of the second pin 274*b* is inserted into the elongated hole 324 of the link member 316*d*.

In this first embodiment, because of the aforementioned structure, the link members 316*a* and 316*c* serve as a pair of members and the link members 316*b* and 316*d* serve as another pair of members. All the link members 316*a*, 316*b*, 316*c* and 316*d* are formed to have the same shape. However, the present invention is not limited to this. It is sufficient for the present invention that each pair of the members, i.e., the pair of the link members 316*a* and 316*c* and the pair of the link members 316*b* and 316*d*, have the same shape.

The pusher 310 is connected to the second U-shaped slider 280 by way of the link members 316*a*, 316*b*, 316*c* and 316*d*. The pusher 310 comprises an article placement portion 312 on which a second lowest-positioned article M2 is placed, and a pushing portion 314 for pushing a lowest-positioned article M1. The pushing portion 314 is located at the front end of the pusher 310. The article placement portion 312 and the pushing portion 314 are formed integrally. The article placement portion 312 has four rectangular openings whose sides are parallel to the x or y axis, and four bearings 334*a*, 334*b*, 334*c* and 334*d* formed to extend downward (i.e., in the direction of −z) at the two opposite sides of the portion 312 along the x-axis. Each of the bearings 334*a*, 334*b*, 334*c* and 334*d* has a circular through hole.

The bearings 334*a* and 334*b* are located on the side of the first sidewall 282 of the second U-shaped slider 280, and the bearings 334*c* and 334*d* are located on the side of the second sidewall 284 thereof. The bearings 334*a* and 334*c* are located on a straight line along the y axis and the bearings 334*c* and 334*d* are located on another straight line along the y axis. The bearings 334*a* and 334*b* are located on a straight line along the x axis and the bearings 334*c* and 334*d* are located on another straight line along the x axis.

One end of the rocking shaft 326 is inserted into the bearing 334*a* and rockably supported by the same and the other end of the rocking shaft 326 is inserted into the bearing 334*c* and rockably supported by the same. One end of the rocking shaft 328 is inserted into the bearing 334*b* and rockably supported by the same and the other end of the rocking shaft 328 is inserted into the bearing 334*d* and rockably supported by the same.

Next, the interconnections among the first and second U-shaped sliders 260 and 280, the link members 316*a*, 316*b*, 316*c* and 316*d*, and the pusher 310 will be explained below with reference to FIG. 7.

The first and second U-shaped sliders 260 and 280, the link members 316*a*, 316*b*, 316*c* and 316*d* and the pusher 310 are movably interconnected by the first and second pins 274*a* and 274*b* and the rocking shafts 298, 300, 326 and 328.

One end of the first pin 274*a* is inserted into the elongated hole 318 of the link member 316*a*, the elongated hole 290*a* of the first sidewall 282 of the second U-shaped slider 280, and the first through hole 270 of the first sidewall 262 of the first U-shaped slider 260. Similarly, the other end of the first pin 274*a* is inserted into the elongated hole 322 of the link member 316*c*, the elongated hole 290*b* of the second sidewall 284 of the second U-shaped slider 280, and the first through hole 270 of the second sidewall 264 of the first U-shaped slider 260.

One end of the second pin 274*b* is inserted into the elongated hole 320 of the link member 316*b*, the elongated hole 292*a* of the first sidewall 282 of the second U-shaped_slider 280, and the second through hole 272 of the first sidewall 262 of the first U-shaped slider 260. Similarly, the other end of the second pin 274*b* is inserted into the elongated hole 324 of the link member 316*d*, the elongated hole 292*b* of the second sidewall 284 of the second U-shaped slider 280, and the second through hole 272 of the second sidewall 264 of the first U-shaped slider 260.

One end of the rocking shaft 298 is inserted into the second shaft hole 332*a* of the link member 316*a* and the first through hole 294 of the first sidewall 282 of the second U-shaped slider 280. Similarly, the other end of the rocking shaft 298 is inserted into the second shaft hole 332*c* of the link member 316*c* and the first through hole 294 of the second sidewall 284 of the second U-shaped slider 280.

One end of the rocking shaft 300 is inserted into the second shaft hole 332*b* of the link member 316*b* and the second through hole 296 of the first sidewall 282 of the second U-shaped slider 280. Similarly, the other end of the rocking shaft 300 is inserted into the second shaft hole 332*d* of the link member 316*d* and the second through hole 296 of the second sidewall 284 of the second U-shaped slider 280.

One end of the rocking shaft 326 is inserted into the first shaft hole 330*a* of the link member 316*a* and the through hole of the bearing 334*a* of the pusher 310. Similarly, the other end of the rocking shaft 326 is inserted into the first shaft hole 330*c* of the link member 316*c* and the through hole of the bearing 334*c* of the pusher 310.

One end of the rocking shaft 328 is inserted into the first shaft hole 330*b* of the link member 316*b* and the through hole of the bearing 334*b* of the pusher 310. Similarly, the other end of the rocking shaft 328 is inserted into the first shaft hole 330*d* of the link member 316*d* and the through hole of the bearing 334*d* of the pusher 310.

The first and second sidewalls 282 and 284 of the second U-shaped slider 280 are positioned inwardly with respect to the link members 316*a*, 316*b*, 316*c* and 316*d*. The first and second sidewalls 262 and 264 of the first U-shaped slider 260 are positioned inwardly with respect to the first and second sidewalls 282 and 284 of the second U-shaped slider 280, respectively.

Figure 8A:
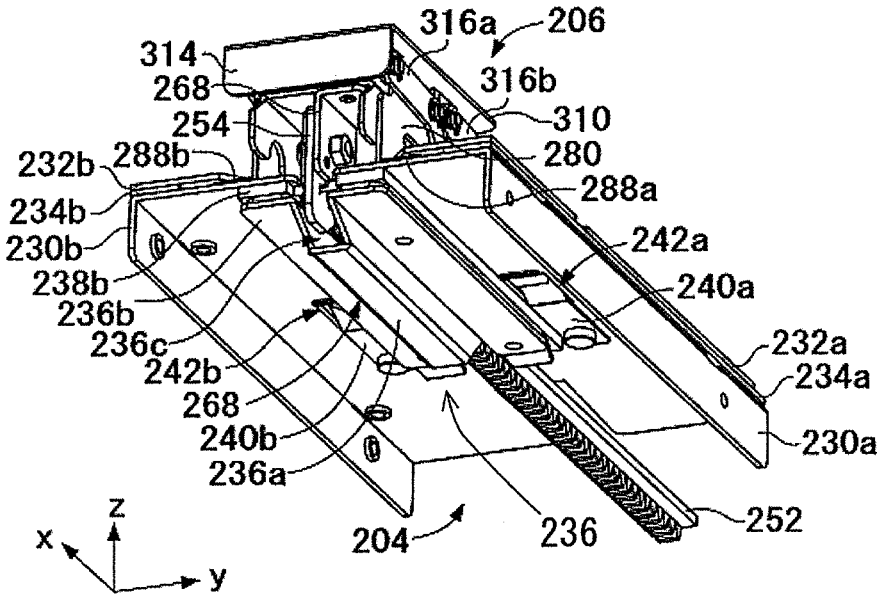
FIG. 8A is a perspective view showing the structure of the pushing subsection and the base of the dispensing section of the article dispensing apparatus according to the first embodiment of FIG. 1.

Next, the base 204 will be explained below with reference to FIGS. 8A and 8B.

The base 204 has a function of supporting the rack gear 252 which is slidable with respect to the base 204 along the x axis, and the first and second U-shaped sliders 260 and 280. The base comprises a pair of base members 230*a* and 230*b*, a pair of upper rail members 232*a* and 232*b*, a pair of first spacers 234*a* and 234*b*, a lower rail member 236, and a pair of second spacers 238*a* and 238*b*. The pair of base members 230*a* and 230*b*, which are extended along the x axis, are coupled with each other to form a U-shaped cross section perpendicular to the x axis. The pair of upper rail members 232*a* and 232*b* are placed on the surface side (i.e., the upper side) of the pair of base members 230*a* and 230*b*. The pair of first spacers 234*a* and 234*b* are placed between the pair of base members 230*a* and 230*b* and the pair of upper rail members 232*a* and 232*b*. The lower rail member 236 is placed on the back side (i.e., the lower side) of the pair of base members 230*a* and 230*b*. The pair of second spacers 238*a* and 238*b* are placed between the pair of base members 230*a* and 230*b* and the lower rail member 236.

The base members 230*a* and 230*b* are fixed to the first and second sidewalls 212 and 214 of the base subsection 200, respectively. The width of each of the base members 230*a* and 230*b* along the y axis is smaller than a half of the interval between the first and second sidewalls 212 and 214. Therefore, a predetermined interval (which is termed the gap "s1" later) is formed between the base members 230*a* and 230*b* along the y axis.

On the surface side of the pair of base members 230*a* and 230*b*, the pair of first spacers 234*a* and 234*b* and the pair of upper rail members 232*a* and 232*b* are fixed, wherein the first spacers 234*a* and 234*b* are respectively in contact with the base members 230*a* and 230*b*, and the upper rail members 232*a* and 232*b* are respectively in contact with the base members 230*a* and 230*b*. Thus, two gaps s2 are respectively formed along the z axis between the base members 230*a* and 230*b* and the upper rail members 232*a* and 232*b*. The brim portions 288*a* and 288*b* of the second U-shaped slider 280 are inserted into these two gaps s2, respectively. The interval between the upper rail members 232*a* and 232*b* is slightly larger than the interval between the first and second sidewalls 282 and 284 of the second U-shaped slider 280. The first spacers 234*a* and 234*b* are slightly larger in thickness than the brim portions 288*a* and 288*b* of the second U-shaped slider 280.

Because of the aforementioned structure, the pair of brim portions 288*a* and 288*b* of the second U-shaped slider 280 can be movably guided by the two gaps s2 formed by the pair of base members 230*a* and 230*b* and the pair of upper rail members 232*a* and 232*b*. Moreover, the second slider 280 can be made slidable along the x axis while the first and second sidewalls 282 and 284 of the second U-shaped slider 280 are respectively guided by the side edges (which are closer to the gap s1) of the upper rail members 232*a* and 232*b*.

On the back side of the pair of base members 230*a* and 230*b*, a pair of second spacers 238*a* and 238*b* and a lower rail member 236 are fixed. The thickness of the second spacers 238*a* and 238*b* along the z axis is slightly larger than the thickness of the flat plate portion of the rack gear 252 which supports the tooth part thereof. Thus, a gap s3 is formed by the second spacers 238*a* and 238*b* between the pair of second spacers 238*a* and 238*b* and the lower rail member 236. The lower rail member 236 is formed to have a hat-shaped cross section perpendicular to the x axis, and comprises a U-shaped protruding portion 236*a* and a pair of brim portions 236*b*. A groove 236*c* is formed in the protruding portion 236*a*.

The internal width of the protruding portion 236*a* (i.e., the width of the groove 236*c*) along the y axis is approximately equal to the gap s1 between the base members 230*a* and 230*b*. The brim portions 236*b* are respectively extended toward the first and second sidewalls 212 and 214 from the two side edges of the protruding portion 236*a*. The lower rail member 236 is located in such a way that the protruding portion 236*a* protrudes downward and the groove 236*c* of the protruding portion 236*a* accords with the gap s1 in this position. The brim portions 236*b* are fixed to the base members 230*a* and 230*b* by way of the second spacers 238*a* and 238*b*, respectively.

The rack gear 252 is inserted into the gap s3 formed by the pair of second spacers 238*a* and 238*b* between the pair of base members 230*a* and 230*b* and the lower rail member 236. The tooth part of the rack gear 252 is placed in the gap between the pair of second spacers 238*a* and 238*b* and the groove 236*c* of the lower rail member 236. Due to such a structure as described here, the rack gear 252 can be guided by the combination of the pair of base members 230*a* and 230*b*, the pair of second spacers 238*a* and 238*b* and the lower rail member 236 and is made slidable along the x axis.

The connecting member 254 is inserted into the groove 236*c* of the lower rail member 236, the gap between the pair of second spacers 238*a* and 238*b*, and the gap s1 between the pair of base members 230*a* and 230*b*. The connecting member 254 interconnects the rack gear 252 and the connected member 268 of the first U-shaped slider 260.

Figure 8B:
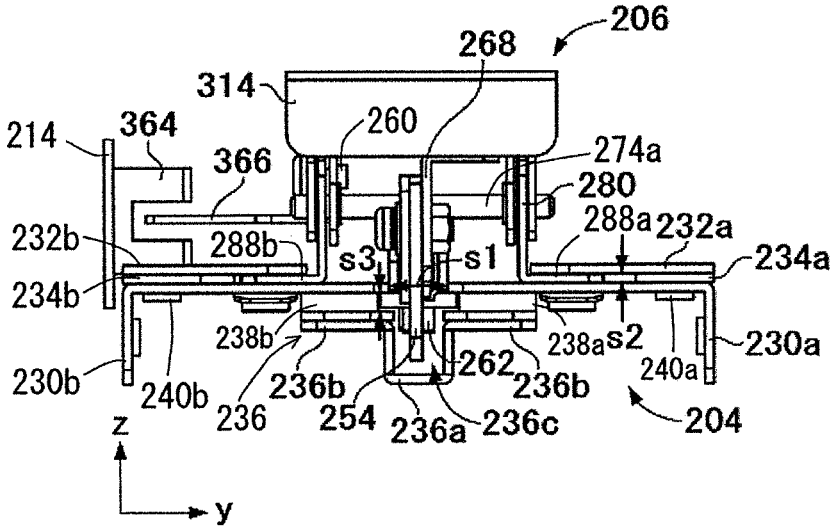
FIG. 8B is a front view showing the structure of the pushing subsection and the base of the dispensing section of the article dispensing apparatus according to the first embodiment of FIG. 1.

A pair of leaf springs 240*a* and 240*b* is provided on the back side of the pair of base members 230*a* and 230*b*, see FIG. 8B. Each of the leaf springs 240*a* and 240*b* are made of a rectangular flat plate with elasticity and have a protrusion which is formed at one end of the plate and which protrudes along the longitudinal axis of the plate. The base members 230*a* and 230*b* have rectangular windows 242*a* and 242*b* formed at their approximately middle portions, respectively, through which the leaf springs 240*a* and 240*b* are respectively projected. More specifically, the windows 242*a* and 242*b* are arranged at the positions which are approximately right under the flap 152 in the storing section 10 or slightly shifted therefrom backward in the direction of −x. The windows 242*a* and 242*b* are partially or entirely overlapped with the brim portions 288*a* and 288*b* of the second U-shaped slider 280 along the y axis, respectively. The protrusions of the leaf springs 240*a* and 240*b* are respectively inserted into the corresponding windows 242 from the back side of the base members 230*a* and 230*b*.

Thus, the protrusions of the leaf springs 240*a* and 240*b* are located on the surface side of the base members 230*a* and 230*b*. The opposite ends of the leaf springs 240*a* and 240*b* to their protrusions are respectively fixed to the base members 230*a* and 230*b* on the back side thereof.

Because of the aforementioned structure, when the second U-shaped slider 280 is moved forward from the first standby position SP1 to the first dispensing position MP1 along the x axis, the brim portions 288*a* and 288*b* of the second U-shaped slider 280 abut on the protrusions of the leaf springs 240*a* and 240*b*, respectively. Therefore, the forward motion of the second U-shaped slider 280 toward the first dispensing position MP1 is restrained by the protrusions of the leaf springs 240*a* and 240*b* until a force applied to the second U-shaped slider 280 by the first U-shaped slider 260 is equal to or greater than a predetermined value. When the force applied to the second U-shaped slider 280 by the first U-shaped slider 260 is equal to or greater than the predetermined value, the protrusions of the leaf springs 240*a* and 240*b* are respectively pushed downward by the second U-shaped slider 280 into the windows 242*a* and 242*b* of the base members 230*a* and 230*b* against the elastic forces of the leaf springs 240*a* and 240*b*. This means that a restraint of the forward motion of the second U-shaped slider 280 toward the first dispensing position MP1 is released.

The mechanism for restraining the motion of the second U-shaped slider 280 is not limited to the one explained herein and other mechanisms can be used for this purpose. Any mechanism can be used if it can restrain the motion of the second U-shaped slider 280 when a force applied to the second U-shaped slider 280 is less than the predetermined value. For example, curved leaf springs may be used instead of the pair of flat plate-shaped leaf springs 240*a* and 240*b*. Moreover, a combination of a pair of restraining members and a pair of springs for energizing the retaining members may be used as this mechanism, in which each restraining member has an inverted V-shaped protrusion or a curved surface, and each spring applies an elastic force to the restraining member toward the surface side of the base member 230*a* or 230*b* by way of the corresponding window 242*a* or 242*b*.

Next, a dispensing sensor 340 will be explained below with reference to FIGS. 1 to 4.

The dispensing sensor 340 has the function of sensing the dispensing operation of an article M from the storing section 10 by way of the dispensing opening 134. The dispensing sensor 340 is fixed near the front end of the passage through which the lowest-positioned article M is moved for dispensing. The sensor part of the sensor 340 is provided at a position before the dispensing opening 134. In this first embodiment, the dispensing sensor 340 is formed by using a transmission type photosensor. Specifically, the dispensing sensor 340 is formed by the combination of a light emitter 340*a* and a light receiver 340*b*. The light receiver 340*b* receives the light emitted from the light emitter 340*a*. By sensing A change of the light amount received by the light receiver 340*b* due to an article M passing between the light emitter 340*a* and the light receiver 340*b*, whether or not the article M is dispensed can be detected.

Although a transmission type photosensor is used for the dispensing sensor 340, the present invention is not limited to this. A reflection type photosensor may be used for this purpose. Moreover, a movable gate member with a shape like a bar or plate may be used. In this case, the gate member is rockably fixed to the base subsection 20 or the storing section 10, and the motion of the gate member is detected by an appropriate switch such as a microswitch, thereby detecting the dispensing operation of an article M.

Next, an empty sensor 350 will be explained below with reference to FIGS. 4 and 8A and 8B.

The empty sensor 350 has the function of sensing the presence or absence of the articles M stored in the storing section 10. In this embodiment, the empty sensor 350 is formed by A combination of a microswitch 354 and a rod 352. The microswitch 354 is fixed to the first sidewall 212 in the base subsection 200 at a position above the base member 230*a* of the base 204. One end of the rod 352 is fixed to the microswitch 354 so that the microswitch 354 is operated by the motion of the rod 352. The rod 352 is obliquely extended forward from the microswitch 354 to a position below the pair of retaining parts 132*a* and 132*b* of the storing section 10.

The rod 352 is energized upward (i.e., in the direction of +z) by an energizing force. Thus, when articles M are stored in the storing section 10, the rod 352 is pressed downward (i.e., toward the base member 230*a*) against the energizing force by the lowest-positioned article M1. On the other hand, when articles M are not stored in the storing section 10, in other words, the storing section 10 is empty, the rod 352 is rocked upward by the energizing force. Due to this upward rocking motion of the rod 352, the microswitch 354 is turned into an OFF state from the ON state, or into the ON state from the OFF state, thereby detecting the presence or absence of articles M in the storing section 10, in other words, whether or not the storing section 10 is empty.

In this first embodiment, the empty sensor 350 is formed by using the microswitch 354; however, the present invention is not limited to this. A reflection type photosensor, a transmission type photosensor or the like may be used for detecting the presence or absence of articles M.

Next, a slider sensing device 360 will be explained below with reference to FIGS. 2, 3, 6, 8A and 8B.

The slider sensing device 360 has the function of sensing whether the second U-shaped slider 280 is located at the first standby SP1 or the first dispensing position MP1. The sensor part of the slider sensing device 360 comprises a first sensing element 362 for sensing whether or not the second U-shaped slider 280 is located at the first standby position SP1, and a second sensing element 364 for sensing whether or not the second U-shaped slider 280 is located at the first dispensing position MP1. Both of the first and second sensing elements 362 and 364 are fixed to the second sidewall 214.

In this first embodiment, a thin transmission type photosensor having a box-shaped body with a cross-sectional shape like a U character, and a light emitter and a light receiver fixed on the body, is used for each of the first and second sensing elements 362 and 364. The light emitter and the light receiver are positioned opposite to each other by way of an intervening recess of the body.

Figure 9:
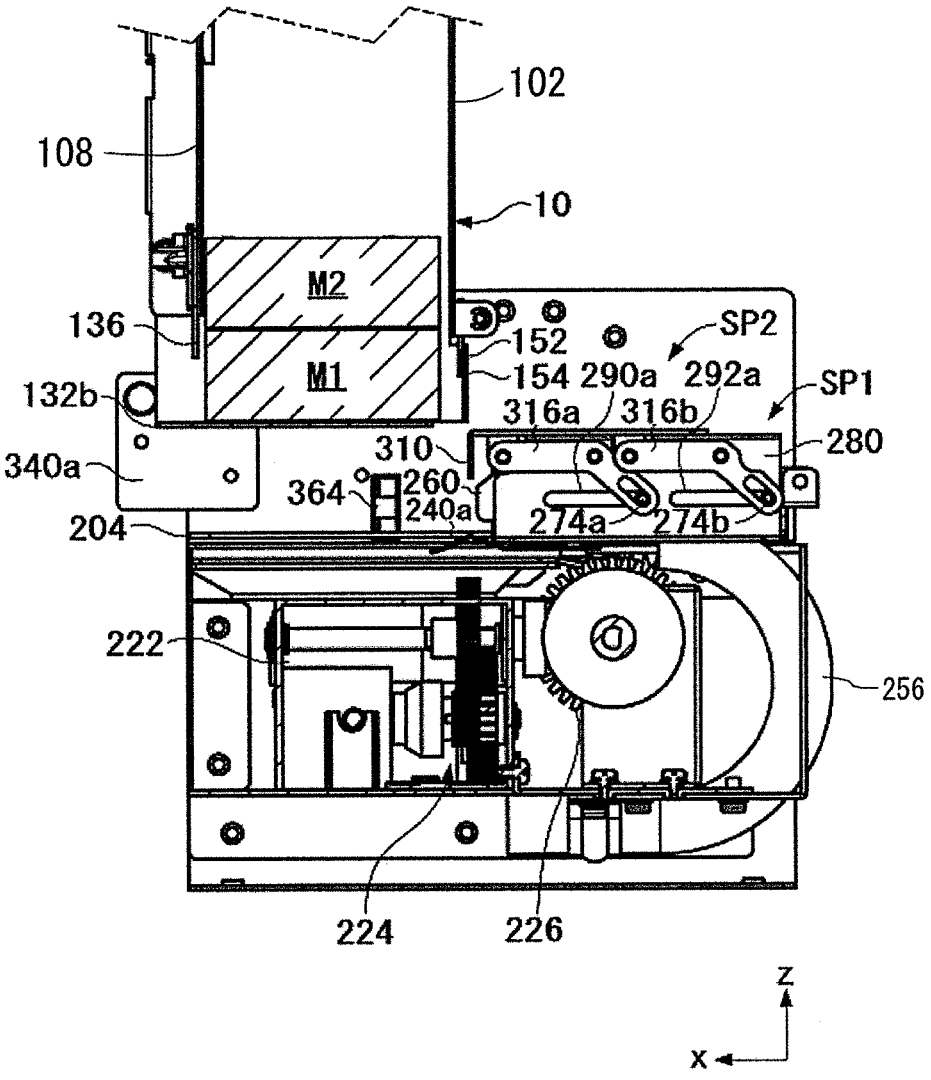
FIG. 9 is a cross-sectional side view showing the dispensing operation of the article dispensing apparatus according to the first embodiment of FIG. 1, in which the pushing subsection is located at a standby position.

On the second sidewall 284 of the second U-shaped slider 280, an elongated sensing plate 366 which protrudes horizontally along the y axis toward the second sidewall 214 of the base subsection 200 is fixed, see FIG. 8B and FIG. 9. The height of the sensing plate 366 is determined in such a manner as to pass through the recesses of the first and second sensing elements 362 and 364. When the second U-shaped slider 280 is located at the first standby position SP1, the sensing plate 366 enters into the recess of the first sensing element 362 to decrease the amount of the light received by the light receiver of the first sensing element 362, thereby sensing the second U-shaped slider 280. On the other hand, when the second slider 280 is located at the first dispensing position MP1, the sensing plate 366 enters into the recess of the second sensing element 364 to decrease the amount of the light received by the light receiver of the second sensing element 364, thereby sensing the second U-shaped slider 280.

When none of the first and second sensing elements 362 and 364 senses the sensing plate 366, in other words, the second U-shaped slider 280 is located between the first standby position SP1 and the first dispensing position MP1, the moving direction of the second U-shaped slider 280 is judged by which one of the first and second sensing elements 362 and 364 has sensed the sensing plate 366 just before. Specifically, when the sensing plate 366 is not sensed by both of the first and second sensing elements 362 and 364, and the plate 366 has been sensed by the first element 362 just before, it is judged that the second U-shaped slider 280 is moving from the first standby position SP1 toward the first dispensing position MP1. On the other hand, when the sensing plate 366 is not sensed by both of the first and second sensing elements 362 and 364, and the plate 366 has been sensed by the second element 364 just before, it is judged that the second U-shaped slider 280 is moving from the first dispensing position MP1 toward the first standby position SP1.

The slider sensing device 360 is not limited to the structure described here and may be formed by, for example, using a reflection type photosensor and/or a microswitch as each of the first and second sensing elements 362 and 364.

[Controlling Section]

Figure 3:
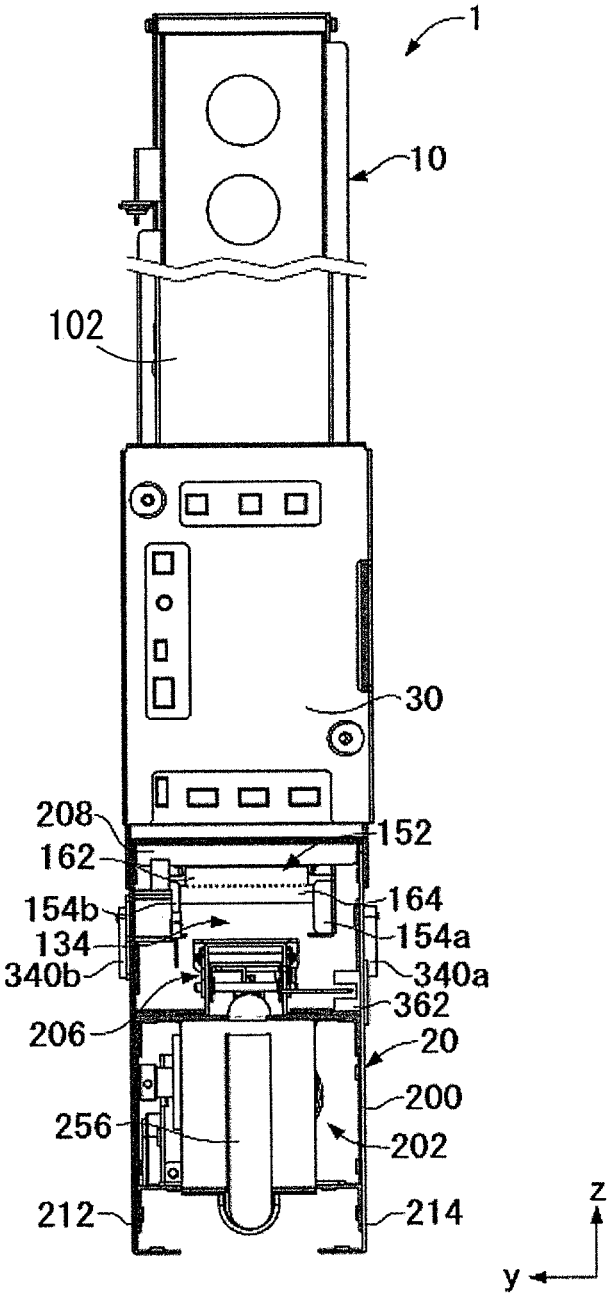
FIG. 3 is a rear view of the article dispensing apparatus according to the first embodiment of FIG. 1, in which the storing section is partially cut away.

Next, the controlling section 30 will be explained below with reference to FIGS. 3 and 4.

The controlling section 30 has the functions of controlling the operation of the driving subsection 202 based on a control signal outputted from an external device (not shown), detecting the state of the pushing subsection 206, i.e., the state of the second U-shaped slider 280, detecting the dispensing operation of articles M, and detecting presence or absence of articles M stored in the storing section 10. The controlling section 30 is provided behind the storing section 10 along the x axis. The controlling section 30 comprises a supporting portion 400, a case 402, and a control substrate 404.

The supporting portion 400 is fixed to the first and second sidewalls 212 and 214 of the dispensing section 20 in such a way as to stand upright. The case 402 is fixed to the supporting portion 400. The control substrate 404 is mounted in the case 402. The mounting state of the control substrate 404 in the case 402 is not limited to the one shown in this first embodiment. The case 402 may be fixed in the storing section 10, and the case 402 may be formed integrally with the storing section 10 or the base subsection 200. The control substrate 404 may be fixed directly to the first and second sidewalls 212 and 214, the bottom plate 216 of the base subsection 200, or the like.

[Dispensing Operation]

Next, the dispensing operation of the article dispensing apparatus 1 according to the first embodiment will be explained below with reference to FIGS. 9 to 17.

FIG. 9 shows the standby state of the article dispensing apparatus 1.

In FIG. 9, the second U-shaped slider 280 is held at the first standby position SP1 which is set at the rear end of the base 204 along the x axis, and the pusher 310 is positioned closest to the second U-shaped slider 280 and located at the second standby position SP2 which is slightly lower than the first and second retaining portions 132*a* and 132*b* of the storing section 10. At this time, the first pin 274*a* is positioned at the rear end of the first elongated hole 290*a* of the first sidewall 282 of the second U-shaped slider 280 and the rear end of the first elongated hole 290*b* of the second sidewall 284 thereof along the x axis. Similarly, the second pin 274*b* is positioned at the rear end of the elongated hole 292*a* of the first sidewall 282 of the second U-shaped slider 280 and the rear end of the second elongated hole 292*b* of the second sidewall 284 thereof along the x axis.

In this state, the link members 316*a*, 316*b*, 316*c* and 316*d* have the following states:

Specifically, as shown in FIG. 9, the front portions of the link members 316*a*, 316*b*, 316*c* and 316*d*, which extend from the corresponding bending portions to the corresponding front ends, are parallel to the x axis. The rear portions of the link members 316*a*, 316*b*, 316*c* and 316*d*, which extend from the corresponding bending portions to the corresponding rear ends, are inclined to the x and z axes in such a way that the bending portions are located higher than the rear ends along the z axis and are shifted forward from the rear ends along the x axis. Therefore, the elongated holes 318, 320, 322 and 324 of the link members 316*a*, 316*b*, 316*c* and 316*d* are inclined in such a way as to extend obliquely upward with respect to the x axis and obliquely forward with respect to the z axis.

Moreover, the first pin 274*a* is located at the rear ends of the elongated holes 318 and 322 of the link members 316*a* and 316*c*. The second pin 274*b* is located at the rear ends of the elongated holes 320 and 324 of the link members 316*b* and 316*d*.

Since the motor 22 and the rack gear 252 are drivably connected to each other by way of the speed reducer 224 and the pinion gear 226, the rotational motion of the motor 222 is converted to the linear motion along the x axis by the rack gear 252 and the pinion gear 226. Thus, due to the rotation of the motor 222, the rack gear 252 is slid forward or backward along the x axis. Since the rack gear 252 is drivably connected to the first U-shaped slider 260 by way of the connecting member 254, the first U-shaped slider 260 is slid along the x axis in conjunction with the sliding motion of the rack gear 252. Moreover, the first slider 260 is connected to the second U-shaped slider 280 by the first and second pins 274*a* and 274*b* and therefore, the second U-shaped slider 280 is slid forward or backward along the x axis by the first U-shaped slider 260.

Here, the rotational direction of the motor 222 for moving the rack gear 252 forward (i.e., in the direction +x) is defined as the first rotational direction R1, and the rotational direction of the motor 222 for moving the rack gear 252 backward (i.e., in the direction −x) is defined as the second rotational direction R2.

If the article dispensing apparatus 1 according to the first embodiment receives a dispensing instruction for dispensing an article M which has been outputted from an external device (not shown), the apparatus 1 starts its article dispensing operation. Specifically, if the instruction signal for dispensing an article M, which is outputted from the control section of the external device, is received by the apparatus 1, the controlling section 30 of the apparatus 1 outputs a control signal for conducting the article dispensing operation to the dispensing section 20, thereby starting the article dispensing operation.

During the article dispensing operation, first, it is judged whether or not the second U-shaped slider 280 is located at the first standby position SP1 by the slider sensing device 360. If the second U-shaped slider 280 is located at the first standby position SP1, the motor 222 starts its rotating operation in the first rotational direction R1 and as a result, the rack gear 252 and the first U-shaped slider 260 are slid forward, i.e., in the direction of +x. On the other hand, if the second U-shaped slider 280 is not located at the first standby position SP1, the motor 222 starts its rotating operation in the second rotational direction R2 and as a result, the rack gear 252 and the first U-shaped slider 260 slide backward, i.e., in the direction of −x, thereby moving the second U-shaped slider 280 to the first standby position SP1. After the second U-shaped slider 280 is detected by the first sensing element 362, the rotational direction of the motor 222 is changed to the first rotational direction R1, which moves the rack gear 252 and the first U-shaped slider 260 forward (i.e., in the direction of +x).

Due to the forward movement of the first U-shaped slider 260 thus caused, the second U-shaped slider 280 starts its forward movement from the first standby position SP1 to the first dispensing position MP1 along the x axis. However, the pair of leaf springs 240*a* and 240*b* is provided on the base 204 in such a way as to abut on the protrusions (i.e., the front ends) of the pair of brim portions 288*a* and 288*b* of the second U-shaped slider 280. Therefore, when the moving force applied to the second U-shaped slider 280 is equal to or less than the predetermined value, the forward movement of the second U-shaped slider movable member 280 in the direction of +x is restrained by the pair of leaf springs 240*a* and 240*b*.

The first and second U-shaped sliders 260 and 280 are drivably interconnected by the first and second pins 274*a* and 274*b*, because the first pin 274*a* is inserted into the first through holes 270 of the first and second sidewalls 262 and 264 of the first U-shaped slider 260 and the first elongated holes 290*a* and 290*b* of the first and second sidewalls 282 and 284 of the second U-shaped slider 280, and the second pin 274*b* is inserted into the second through holes 272 of the first and second sidewalls 262 and 264 of the first U-shaped slider 260 and the second elongated holes 292*a* and 292*b* of the first and second sidewalls 282 and 284 of the second U-shaped slider 280.

However, the first pin 274*a* is movable along the x axis within the first elongated holes 290*a* and 290*b* of the first and second sidewalls 282 and 284 of the second U-shaped slider 280, and the second pin 274*b* is movable along the x axis within the second elongated holes 292*a* and 292*b* of the first and second sidewalls 282 and 284 of the second U-shaped slider 280. For this reason, after the protrusions of the brim portions 288*a* and 288*b* of the second U-shaped slider 280 abut respectively on the leaf springs 240*a* and 240*b*, the first U-shaped slider 260 is moved forward and at the same time, the first pin 274*a* is slid forward along the x axis within the first elongated holes 290*a* and 290*b* of the second U-shaped slider 280, and the second pin 274*b* is slid forward along the x axis within the second elongated holes 292*a* and 292*b* of the second U-shaped slider 280. In this way, the force transmitted to the second U-shaped slider 280 from the first U-shaped slider 260 is kept equal to or less than the predetermined value, thereby restraining the movement of the second U-shaped slider 280 along the x axis.

If the first U-shaped slider 260 is slid forward in the state where the movement of the second U-shaped slider 280 is thus restrained, the first pin 274*a* is slid forward along the x axis within the first elongated holes 290*a* and 290*b* of the second U-shaped slider 280, and the inner edges of the elongated hole 318 of the link member 316*a* and the elongated hole 322 of the link member 316*c* are pushed forward by the first pin 274*a* along the x axis. Similarly, the second pin 274*b* is slid forward along the x axis within the second elongated holes 292*a* and 292*b* of the second U-shaped slider 280, and the inner edges of the elongated hole 320 of the link member 316*b* and the elongated hole 324 of the link member 316*d* are pushed forward by the second pin 274*b* along the x axis.

However, the link members 316*a* and 316*c* are movably connected by the rocking shaft 298 and are rockable around the shaft 298 with respect to the second U-shaped slider 280. Thus, even if the inner edges of the elongated hole 318 of the link member 316*a* and the elongated hole 322 of the link member 316*c* are pushed forward by the first pin 274*a* along the x axis, the link members 316*a* and 316*c* are not moved along the x axis, and the link members 316*a* and 316*c* are rotated around the shaft 298 clockwise in FIG. 9 with respect to the second U-shaped slider 280 instead.

Similarly, the link members 316*b* and 316*d* are movably connected by the rocking shaft 300 and are rotated around the shaft 300 with respect to the second U-shaped slider 280. Thus, even if the inner edges of the elongated hole 320 of the link member 316*b* and the elongated hole 324 of the link member 316*d* are pushed forward by the second pin 274*b* along the x axis, the link members 316*b* and 316*d* are not moved along the x axis, and the link members 316*b* and 316*d* are rotated around the shaft 300 clockwise in FIG. 9 with respect to the second U-shaped slider 280 instead.

Figure 10:
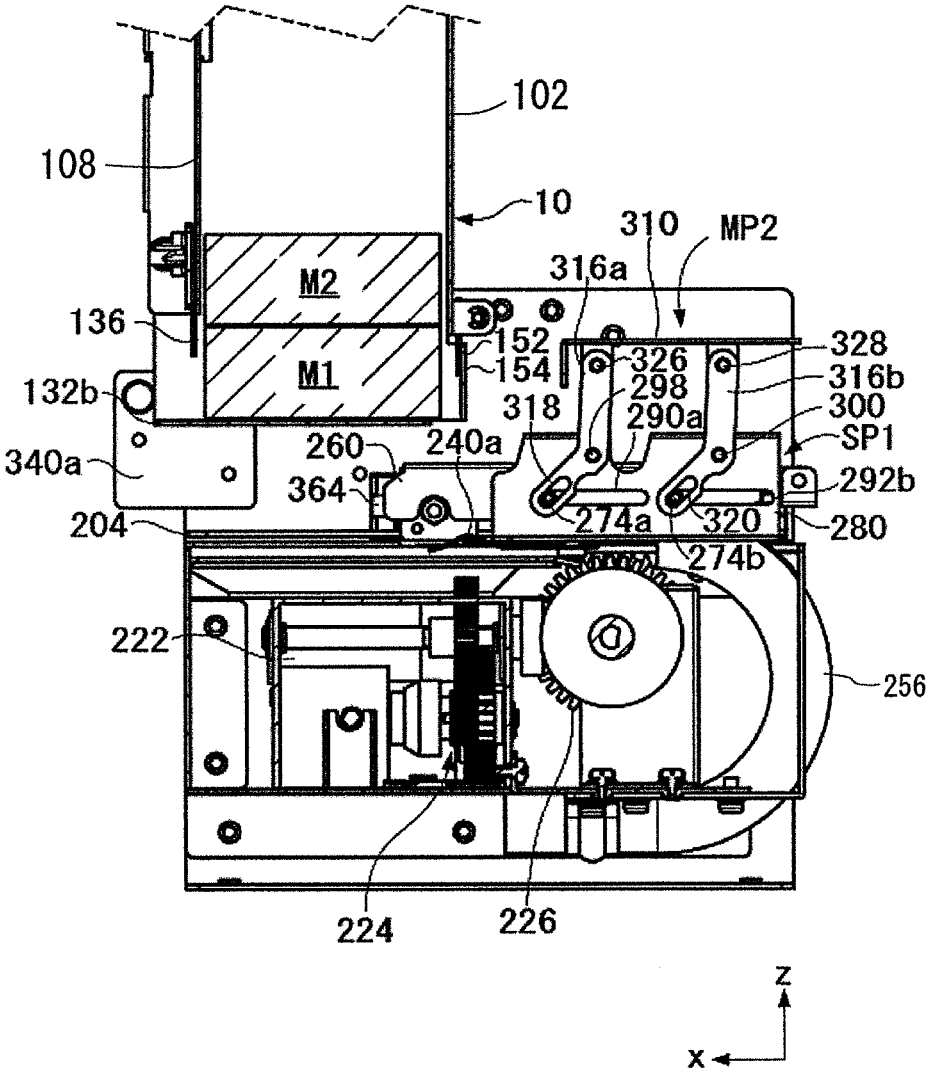
FIG. 10 is a cross-sectional side view showing the dispensing operation of the article dispensing apparatus according to the first embodiment of FIG. 1, in which the pusher is moved to a dispensing position.

Accordingly, the link members 316*a*, 316*b*, 316*c* and 316*d* are turned to an uprising state with respect to the second U-shaped slider 280. In this state, the pusher 310 is moved to the second dispensing position MP2 which is higher than the first and second retaining parts 132*a* and 132*b* in the storing section 10 and lower than the top face of the lowest-positioned article M1 in position, as shown in FIG. 10. This is because the pusher 310 is movably engaged with the first shaft holes 330*a* and 330*c* of the link members 316*a* and 316*c* by way of the rocking shaft 326, and the first shaft holes 330*b* and 330*d* of the link members 316*b* and 316*d* by way of the rocking shaft 328.

After the movement of the pusher 310 to the second dispensing position MP2 (FIG. 10) is completed, the first pin 274*a* is located at the front ends of the first elongated holes 290*a* and 290*b* of the second U-shaped slider 280 and the second pin 274*b* is located at the front ends of the second elongated holes 292*a* and 292*b* of the second U-shaped-_slider 280. Therefore, almost all the force acting from the first U-shaped slider 260 which is moving forward along the x axis is transmitted to the second U-shaped slider 280 by way of the first and second pins 274*a* and 274*b*. In this case, the force for moving the second U-shaped slider 280 forward exceeds the predetermined value for getting over the force of the pair of leaf springs 240*a* and 240*b*. As a result, the protrusions (i.e., the front ends) of the brim portions 288*a* and 288*b* of the second U-shaped slider 280 overpower the pair of leaf springs 240*a* and 240*b*, thereby moving the second U-shaped slider 280 forward toward the first dispensing position MP1 along the x axis.

Figure 12:
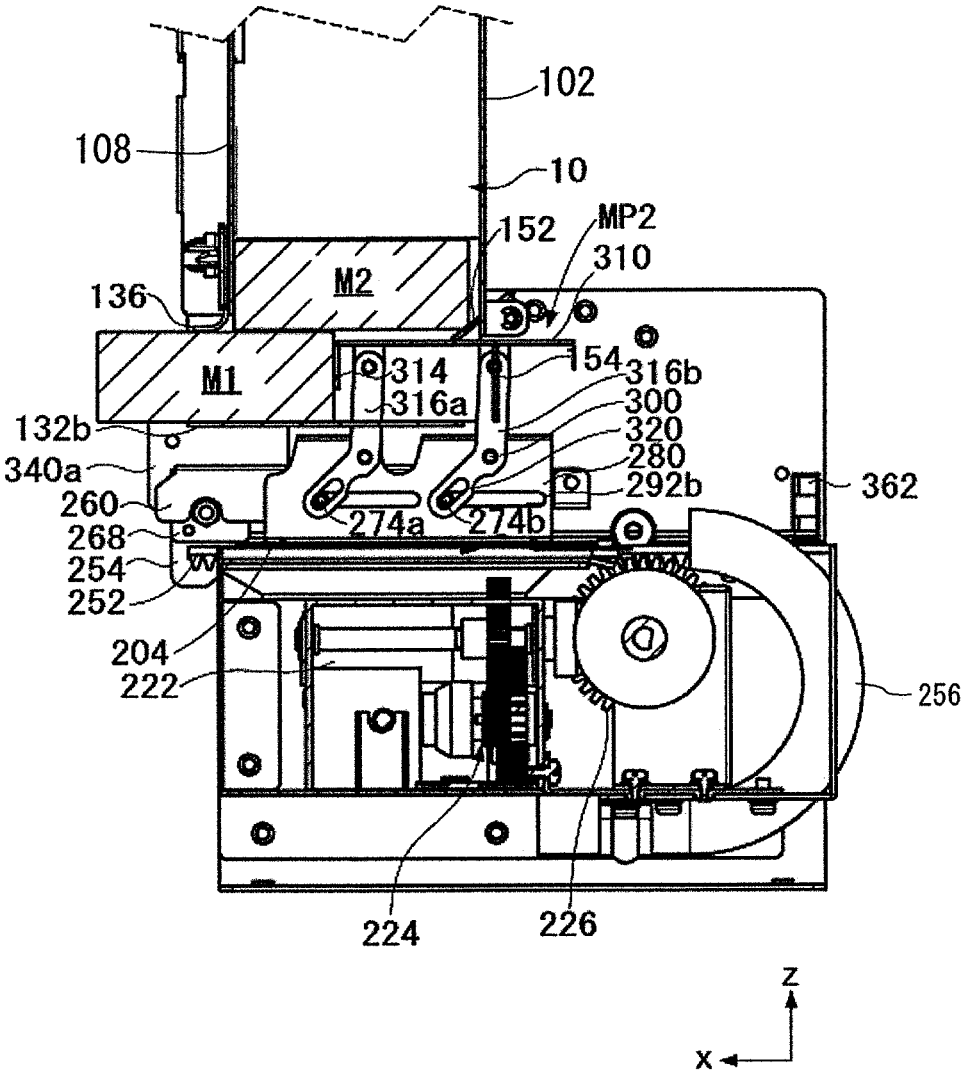
FIG. 12 is a cross-sectional side view showing the dispensing operation of the article dispensing apparatus according to the first embodiment of FIG. 1, in which the pushing subsection is pushing the lowest-positioned article.

When the second U-shaped slider 280 gets over the pair of leaf springs 240*a* and 240*b* and is further moved toward the first dispensing position MP1, the pushing portion 314 of the pusher 310 which is located at the second dispensing position MP2 abuts on the flap 152 of the storing section 10. Since the flap 152 is rockable around the rocking shaft 160 in the forward direction, in other words, rockable clockwise around the shaft 160 in FIG. 11. Therefore, if the second U-shaped slider 280 is further slid toward the first dispensing position MP1 along the x axis, the flap 152 is pushed and rotated around the shaft 160 by the pusher portion 314, thereby enabling the pusher 310 to go into the storing section 10, as shown in FIGS. 11 and 12.

Figure 13:
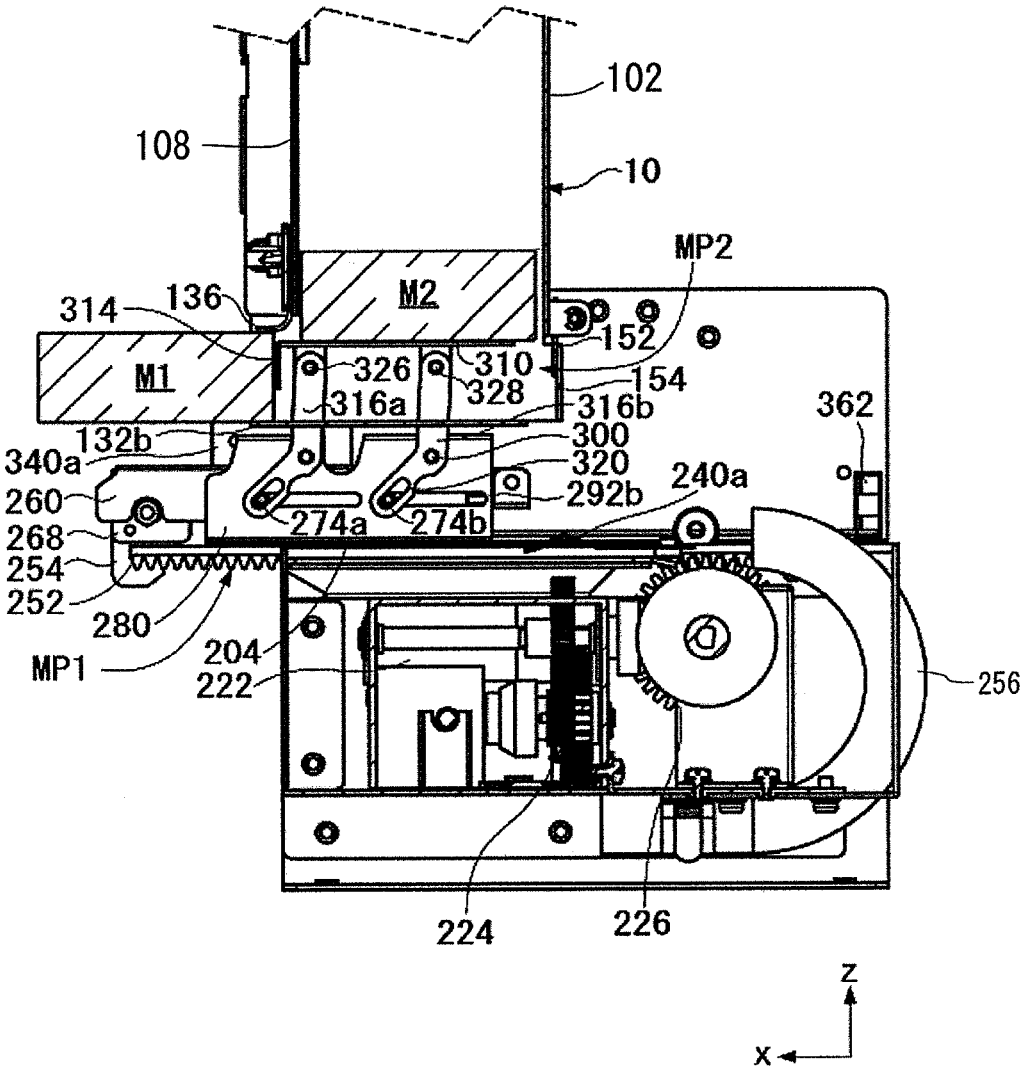
FIG. 13 is a cross-sectional side view showing the dispensing operation of the article dispensing apparatus according to the first embodiment of FIG. 1, in which the pushing subsection has pushed out the lowest-positioned article from the article storing section.

After the pusher 310 goes into the storing section 10, the pusher portion 314 is contacted with the rear end or wall of the lowest-positioned article M1 in the stack of articles M in the storing section 10. Moreover, when the second U-shaped slider 280 is further moved toward the first dispensing position MP1 along the x axis, the lowest-positioned article M1 is further pushed by the pusher portion 314 and pushed out from the storing section 10 through the dispensing opening 134. When the second U-shaped slider 280 reaches the first dispensing position MP1, the lowest-positioned article M1 is entirely pushed out from the storing section 10 and as a result, the article M1 is dispensed from the article dispensing apparatus 1, as shown in FIGS. 12 and 13.

Figure 14:
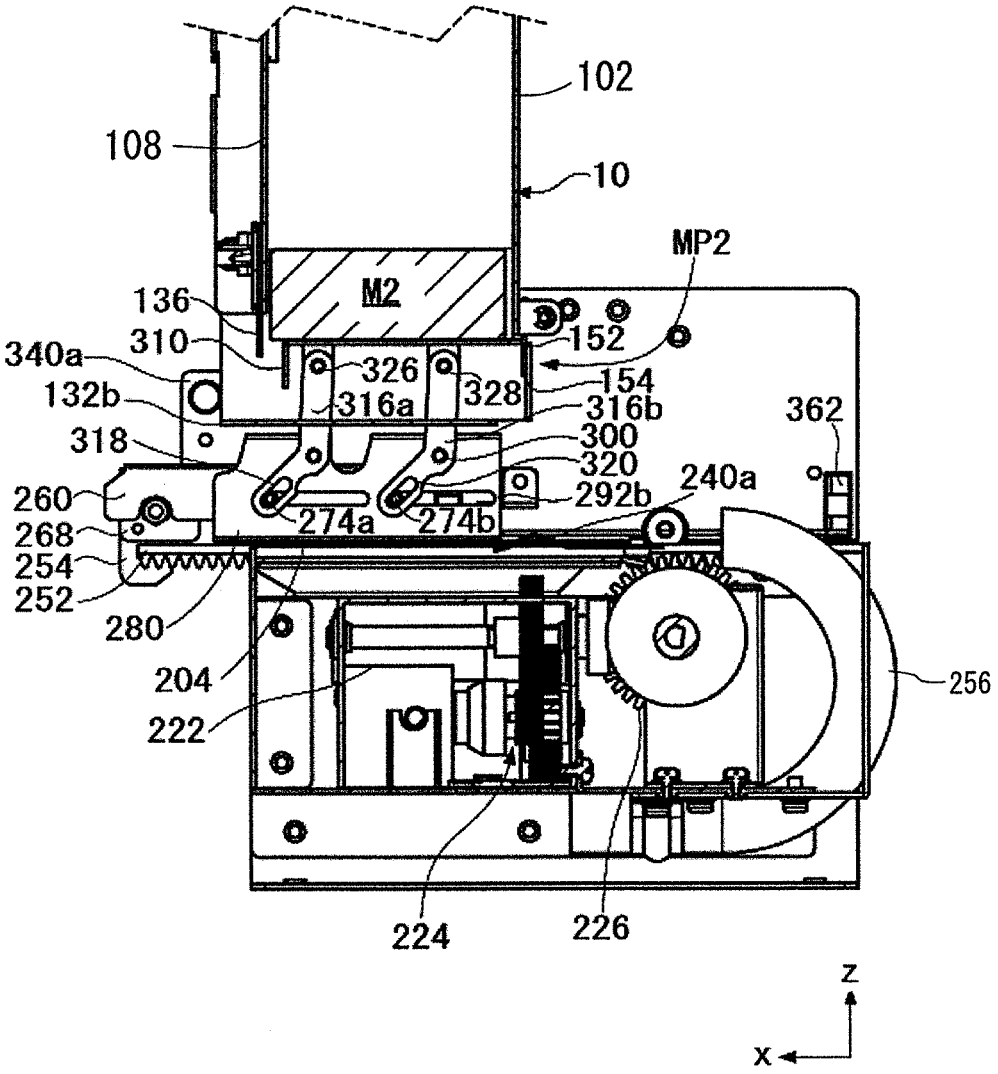
FIG. 14 is a cross-sectional side view showing the dispensing operation of the article dispensing apparatus according to the first embodiment of FIG. 1, in which the pushing subsection has started its motion toward the standby position.

As the lowest-positioned article M1 is pushed out of the storing section 10 by the pusher portion 314 in the direction of +x, the contact area between the top face of the lowest-positioned article M1 and the bottom face of the second lowest-positioned article M2 decreases gradually. This means that the supporting area for the second lowest-positioned article M2 by the lowest-positioned article M1 decreases gradually. For this reason, the rear end of the second lowest-positioned article M2 is displaced downward from a state where the article M2 is horizontally supported by the lowest-positioned article M1 and finally, the article M2 is entirely placed on the article placement portion 312 of the pusher 310. If the second U-shaped slider 280 reaches the first dispensing position MP1 and thus, the contacting area between the top face of the lowest-positioned article M1 and the bottom face of the second lowest-positioned article M2 is ejected, in other words, the article M1 is completely pushed out from the storing section 10, the support for the article M2 by the article M1 disappears completely and the article M2 drops naturally onto the article placement portion 312, thereby keeping the article M2 in the horizontal state, as shown in FIG. 14.

When the lowest-positioned article M1 is dispensed, the pushing subsection 206 is moved backward, i.e., in the direction of −x. In other words, when the fact that the second U-shaped slider 280 has reached the first dispensing position MP1 is detected by the second sensing element 364 of the slider sensing device 360, and the fact that the article M1 has been dispensed is detected by the dispensing sensor 340, the motor 222 is rotated in the second rotational direction R2 to move the rack gear 250 and the first U-shaped slider 260 backward along the x axis, thereby retreating the first U-shaped slider movable member 260 in the direction of −x.

As the first U-shaped slider 260 is moved backward in the direction of −x, the second U-shaped slider 280 and the pusher 310 start their movements toward the back along the x axis. Since the pusher 310 is held at the second dispensing position MP2, the rear end of the pusher 310 abuts on the flap 152 at the rear end of the storing section 10 along the x axis. The rotating motion of the flap 152 around the rotating shaft 160 toward the back (i.e., the direction of −x) from the drooping state, in other words, the counterclockwise rotation motion of the flap 152 in FIG. 14, is restrained by the pair of rear stoppers 154*a* and 154*b* provided at the lower end of the first sidewall 102 of the storing section 10. Thus, even if the pusher 310 abuts on the flap 152, the flap 152 is unable to be rotated toward the back. As a result, the pusher 310 located at the second dispensing position MP2 is restrained from being moved in the direction of −x.

Moreover, because the motion of the pusher 310 in the direction of −x is restrained in this way, the link members 316*a* and 316*c* which are linked with the pusher 310 by way of the rocking shaft 326 and the link members 316*b* and 316*d* which are linked with the pusher 310 by way of the rocking shaft 328 are also restrained from being moved in the direction of −x.

Even if the movement of the pusher 310 in the direction of −x, the first U-shaped slider 260 will continue moving in the backward direction and thus, the first U-shaped slider 260 is moved in the direction of −x and the first and second pins 274*a* and 274*b* are moved in the same direction of −x. However, the link members 316*a*, 316*b*, 316*c* and 316*d* are restrained from being moved in the direction of −x. In addition, as described previously, the link members 316*a* and 316*c* are linked with the second U-shaped slider 280 by way of the rocking shaft 298 to be rockable around the shaft 298, and the link members 316*b* and 316*d* are linked with the second U-shaped slider 280 by way of the rocking shaft 300 to be rockable around the shaft 300.

For this reason, the first pin 274*a* is moved backward in the elongated holes 318 and 322 of the link members 316*a* and 316*c* in the direction of −x, and the inner edges of the elongated holes 318 and 322 are pushed by the first pin 274*a*. However, the link members 316*a* and 316*c* are not moved in the direction of −x and rotate around the shaft 298 in a counterclockwise direction in FIG. 15. Similarly, the second pin 274*b* is moved backward in the elongated holes 320 and 324 of the link members 316*b* and 316*d* in the direction of −x, and the inner edges of the elongated holes 320 and 324 are pushed by the second pin 274*b*. However, the link members 316*b* and 316*d* are not moved in the direction of −x and rotate around the shaft 300 in a counterclockwise direction in FIG. 15.

Figure 15:
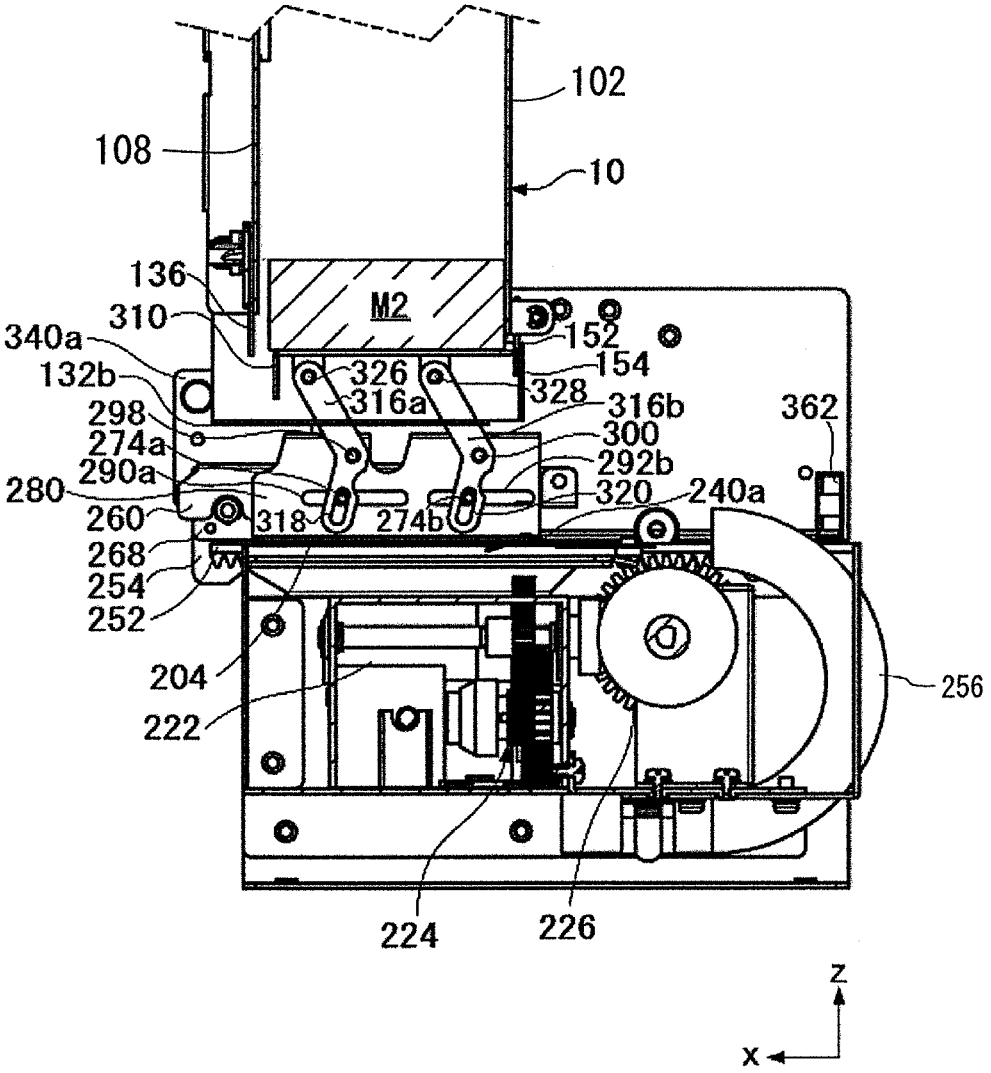
FIG. 15 is a cross-sectional side view showing the dispensing operation of the article dispensing apparatus according to the first embodiment of FIG. 1, in which the motion of the pusher is restrained by a flap provided in the storing section.

Accordingly, the link members 316*a* and 316*c* are rotated around the shaft 298 in a counterclockwise direction in FIG. 15 and the link members 316*b* and 316*d* are also rotated around the shaft 300 in a counterclockwise direction in FIG. 15 also, which moves the pusher 310 to the second standby position SP2 from the second dispensing position MP2. If the pusher 310 is moved to the second standby position SP2 from the second dispensing position MP2, the position (height) of the pusher 310 along the z axis is lower than the lower end of the flap 152, and the pusher 310 does not contact with the flap 152. In this way, the restraint on the backward motion of the pusher 310 in the direction of −x is released, as shown in FIGS. 15 and 16.

The pair of retaining parts 132*a* and 132*b* is formed at positions which are lower than the second dispensing position MP2 of the pusher 310 and higher than the second standby position SP2 of the pusher 310. The width of the pusher 310 along the y axis is set to be smaller than the interval between the retaining parts 132*a* and 132*b*. The movement of the pusher 310 in the direction of −x is restrained by the flap 152, and the pusher 310 is configured to pass through the space between the retaining parts 132*a* and 132*b* during the moving process from the second dispensing position MP2 to the second standby position SP2. Therefore, the supporting means for the second lowest-positioned article M2 is changed from the article placement portion 312 of the pusher 310 to the pair of retaining parts 132*a* and 132*b* during the moving process of the pusher 310 from the second dispensing position MP2 to the second standby position SP2. For this reason, if the pusher 310 is moved to the second standby position SP2, the pusher 310 does not contact with the articles M stored in the storing section 10. In this state, the lowest-positioned article M1 is not pushed by the pusher 310 even if the pusher 310 is moved in any of the directions of +x and −x, as shown in FIG. 16.

After the pusher 310 is moved to the second standby position SP2, the first U-shaped slider 260 is moved backward in the direction of −x, and the second U-shaped slider 280 is moved in the same direction of −x from the first dispensing position MP1 to the first standby position SP1. In this state, in the same way as the case where the second U-shaped slider 280 is moved along the x axis from the first standby position SP1 toward the first dispensing position MP1, the rear ends of the pair of brim portions 288*a* and 288*b* of the second U-shaped slider 280 abut on the pair of leaf springs 240*a* and 240*b*, which restrains the backward movement of the second U-shaped slider 280 in the direction of −x.

However, when the pusher 310 is located at the second standby position SP2, the first pin 274*a* is located at the rear ends of the first elongated holes 290*a* and 290*b* of the second U-shaped slider 280 along the x axis, and the second pin 274*b* is located at the rear ends of the second elongated holes 292*a* and 292*b* of the second U-shaped slider 280 along the x axis. Therefore, almost all the force acting from the first U-shaped slider 260 which is moving backward along the x axis is transmitted to the second U-shaped slider 280 by way of the first and second pins 274*a* and 274*b*. In this case, the force for moving the second U-shaped slider 280 backward exceeds the predetermined value for getting over the pair of leaf springs 240*a* and 240*b*. As a result, the rear ends of the brim portions 288*a* and 288*b* of the second U-shaped slider 280 get over the pair of leaf springs 240*a* and 240*b*, thereby moving the second U-shaped slider 280 to the first standby position SP1 along the x axis.

Figure 17:
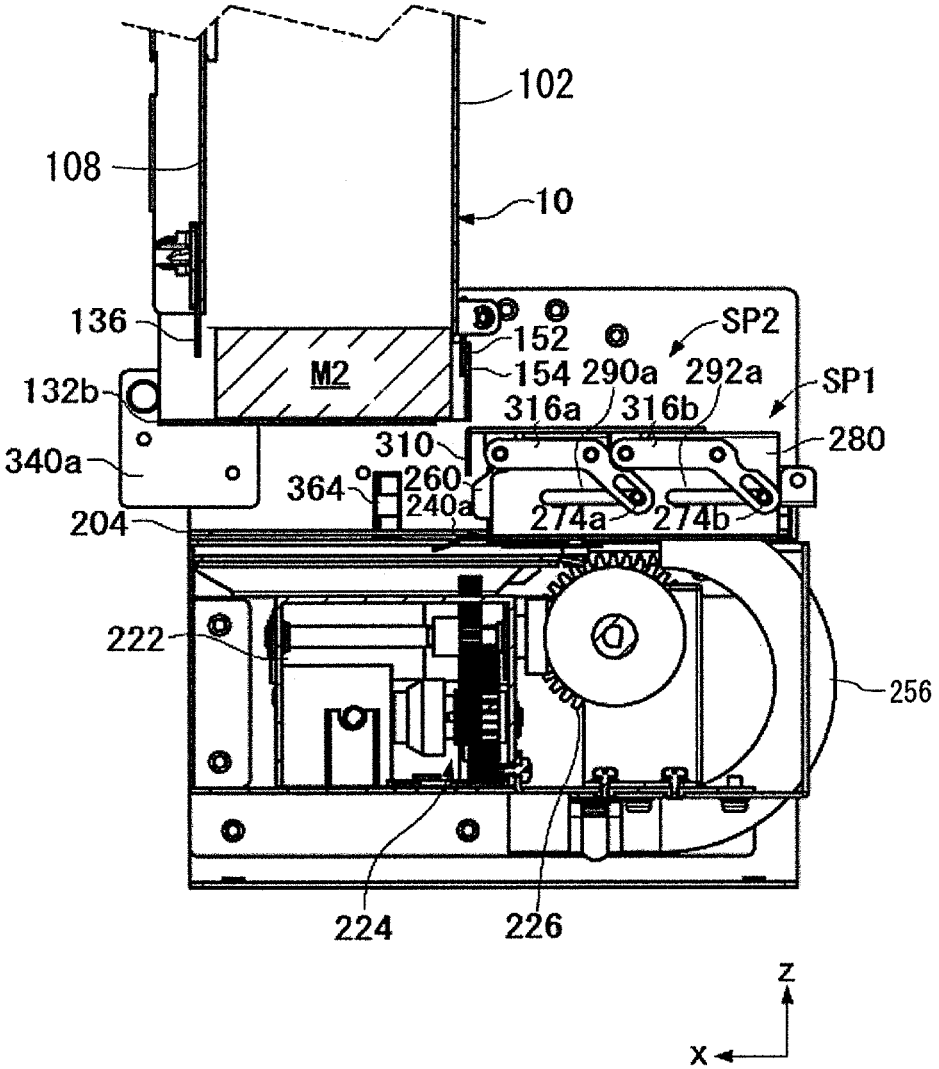
FIG. 17 is a cross-sectional side view showing the dispensing operation of the article dispensing apparatus according to the first embodiment of FIG. 1, in which the motion of the pushing subsection to the standby position has been completed.
Figure 18:
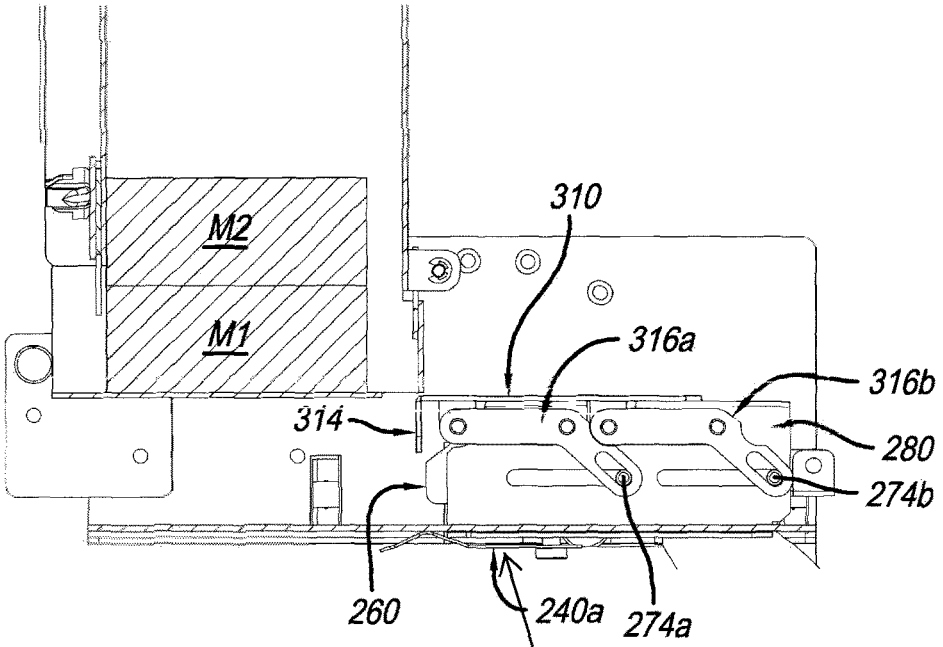
FIG. 18 is a cross sectional view of the article dispensing apparatus in which the motion of the first pusher is restrained by leaf springs in the dispensing section that restrains forward movement of the first U-shaped slider.
Figure 19:
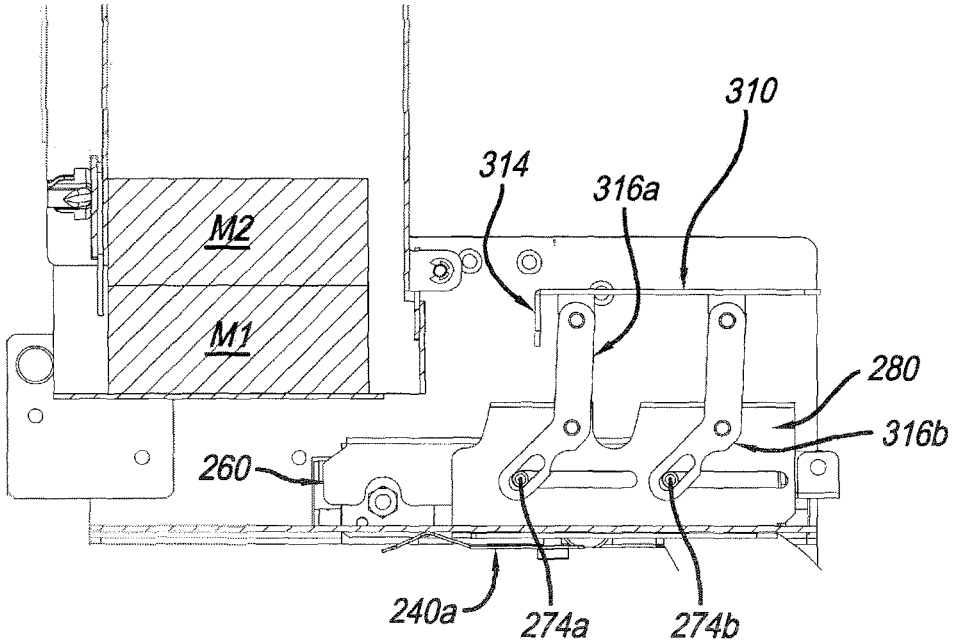
FIG. 19 is a cross sectional view of the article dispensing apparatus after the links are elevated to raise the pusher by movement of the second U-shaped slider to retract the leaf springs below the second U-shaped slider.
Figure 20:
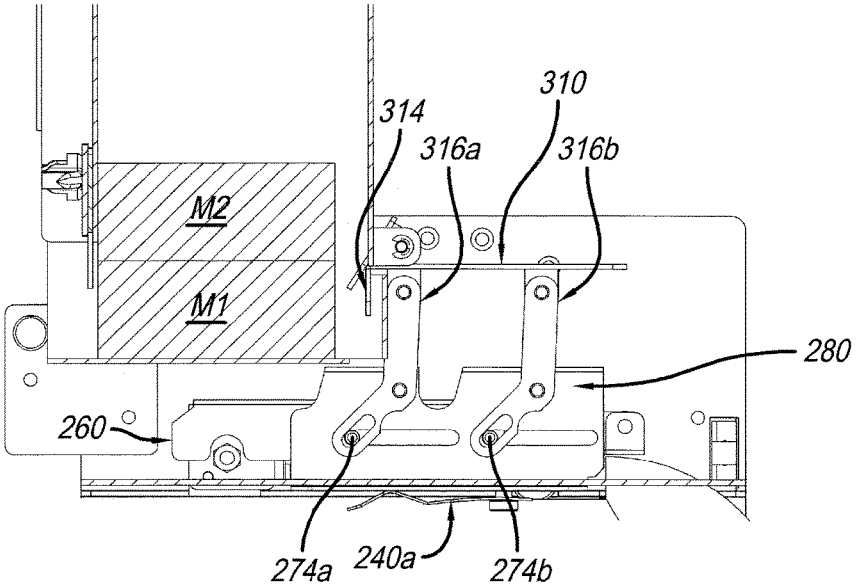
FIG. 20 is a cross sectional view of the article dispensing apparatus with the pusher elevated to dispense an article.
Figure 21:
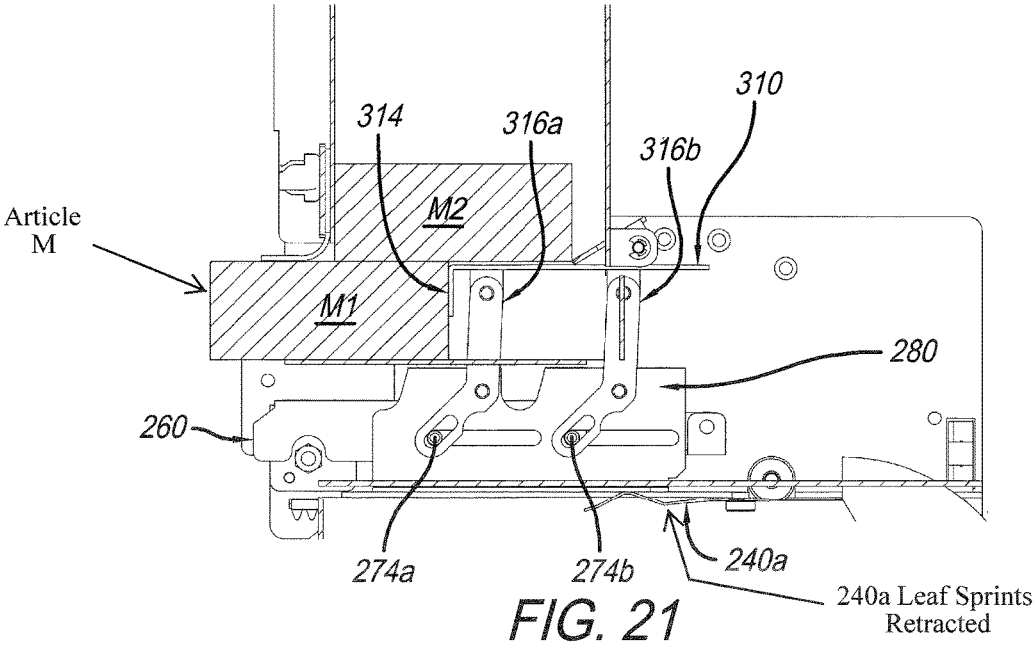
FIG. 21 is a cross sectional view of the article dispensing apparatus with the pusher in the process of dispensing an article with the leaf springs retracted.
Figure 22:
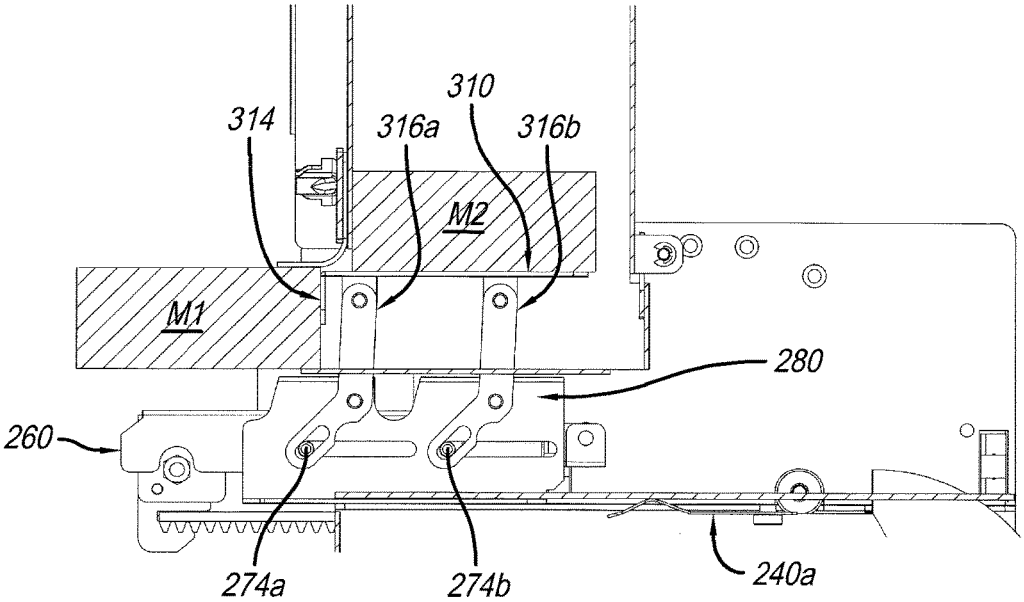
FIG. 22 is a cross sectional view of the article dispensing apparatus with the pusher positioned to dispense the article M1 and the leaf springs positioned behind the first U-shaped slider.
Figure 23:
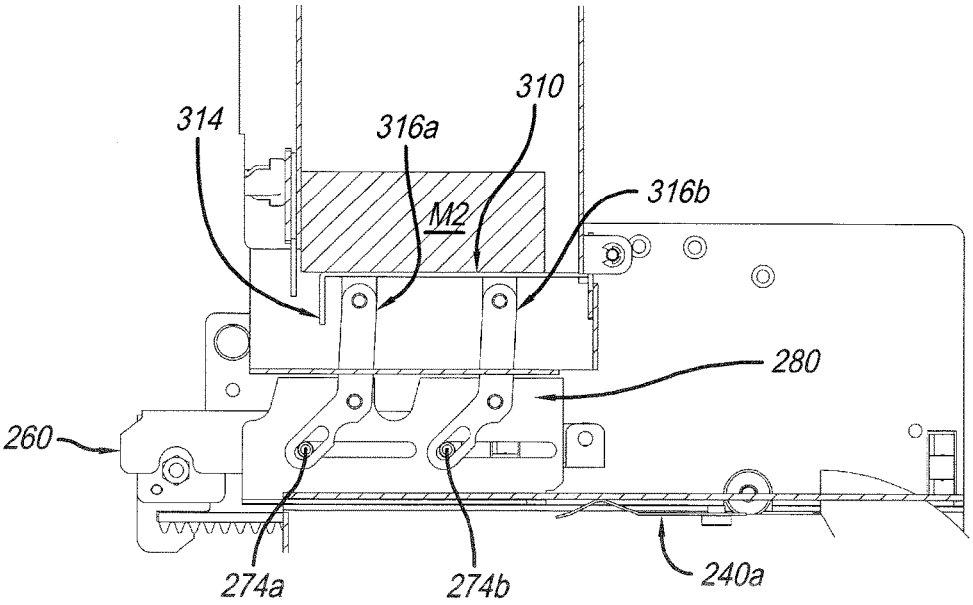
FIG. 23 is a cross sectional view of the first U-shaped slider supporting an article with the article positioned on the pusher with the links elevated.
Figure 24:
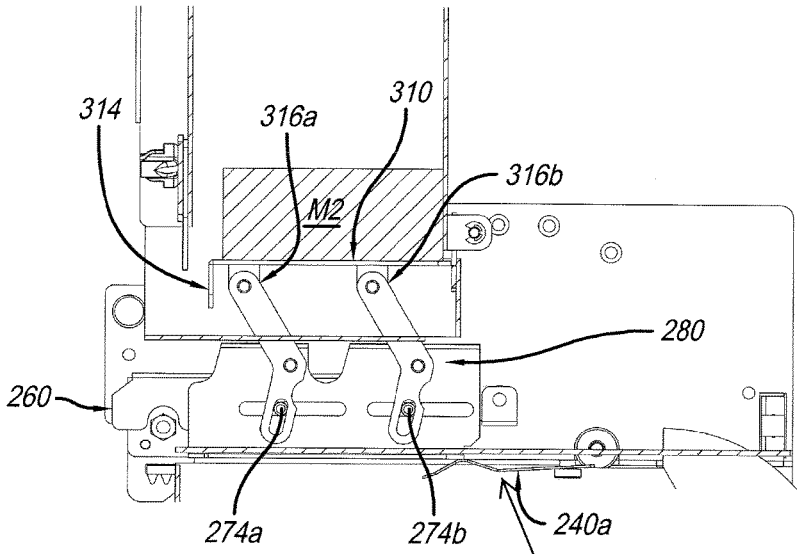
FIG. 24 is a cross sectional view of the article dispensing apparatus with the rear edge of a first U-shaped slider being restrained from rearward movement by leaf springs, while the pusher and the links are lowered by movement of the second U-shaped slider into the first U-shaped slider.
Figure 25:
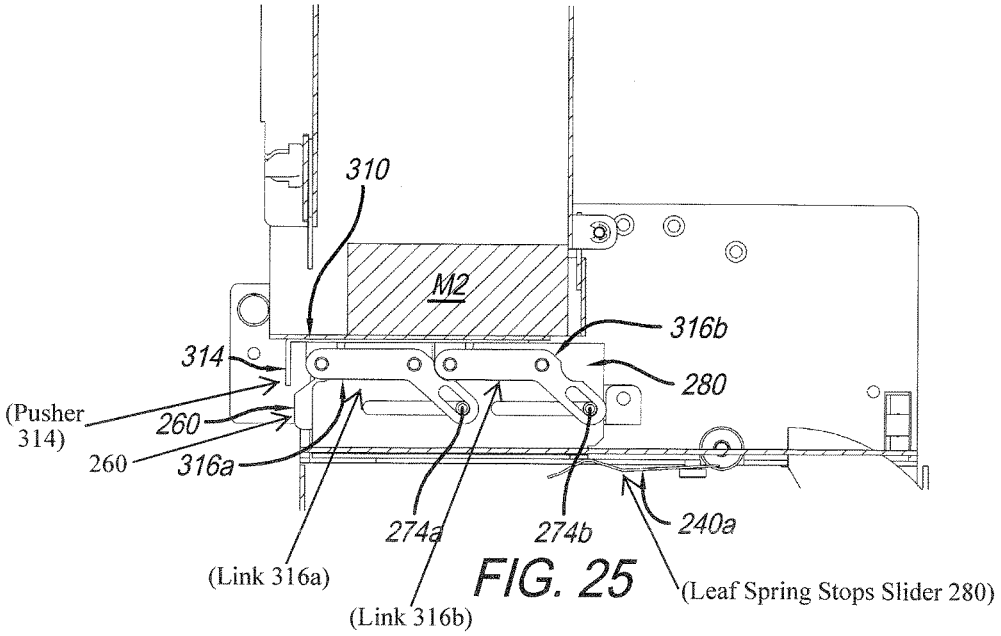
FIG. 25 is a cross sectional view of the article dispensing apparatus with the leaf springs stopping a retraction movement of the first U-shaped slider, while the pusher and links are lowered by movement of the second U-shaped slider onto the first U-shaped slider.
Figure 26:
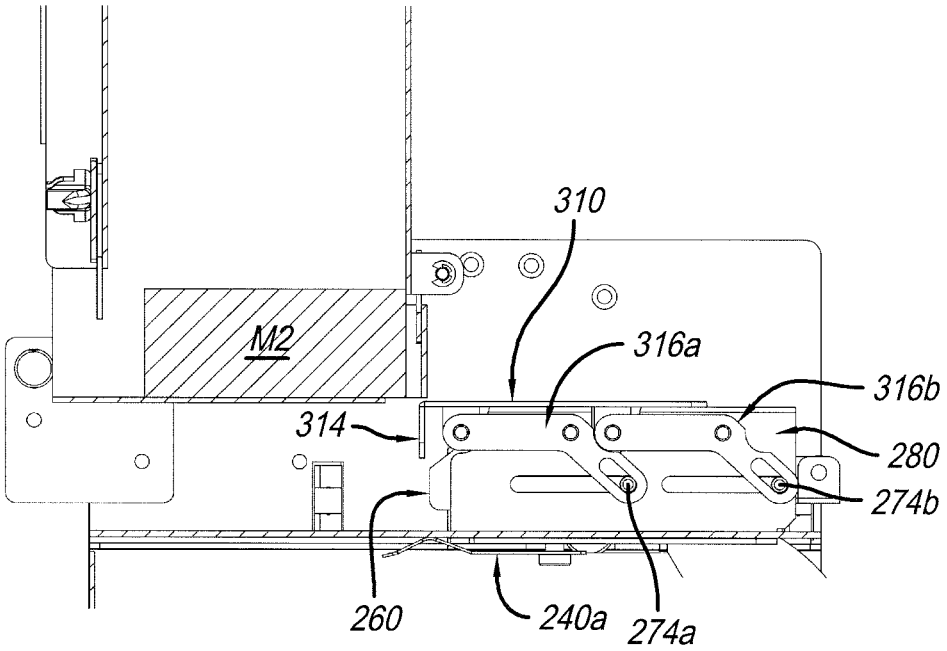
FIG. 26 is a cross sectional view of the article dispensing apparatus with the second U-shaped slider positioned in the first U-shaped slider with the pusher and links retracted and returned to an initial start position by movement of the pins in the elongated holes.

If the second U-shaped slider 280 thus moved is detected by the first sensing element 362 of the slider sensing device 360, and it is judged that the second U-shaped slider 280 is located at the first standby position SP1, the dispensing operation of the articles M of the article dispensing apparatus 1 is finished, as shown in FIG. 17.

With the article dispensing apparatus 1 according to the first embodiment of the present invention, as described above in detail, the pair of retaining parts 132*a* and 132*b* (which corresponds to the retainer) for retaining the stack of articles M is formed in the storing space of the storing section 10 and therefore, not only the stack of the articles M can be held in the storing space of the storing section 10 before the lowest-positioned article is dispensed but also the remainder of the stack can be held in the storing space after the lowest-positioned article is dispensed.

Moreover, the dispensing section 20 comprises the first U-shaped slider 260 moved by the motor 222 (which corresponds to the driving device), the second U-shaped slider 280 moved in conjunction with the first U-shaped slider 260, and the pusher 310 moved in conjunction with the first and second U-shaped sliders 260 and 280, thereby dispensing the lowest-positioned article M1 from the stack through the dispensing opening 134. In addition, the pusher 310 comprises the article placement portion 312 on which the remainder of the articles M is placed after the lowest-positioned article M1 is dispensed.

Therefore, during the dispensing operation which is controlled by the controlling section 30, the remainder of the articles M can be received temporarily on the article placement portion 312 of the pusher 310 in such a way that a lowest-positioned one of the remainder (i.e., the second lowest-positioned article M2 in the stack) keeps its ordinary attitude in the storing space.

Accordingly, a lowest-positioned article M1 can be repeatedly dispensed from the stack of articles M while keeping the second lowest-positioned article M2 in a stable situation.

Furthermore, during the dispensing operation, the pusher 310 pushes forward the lowest-positioned article M1 stored in the storing space from its back surface, thereby dispensing the lowest-positioned article M1 through the dispensing opening 134 in the dispensing direction, and receives temporarily the remainder of the articles M on the article placement portion 312 in such a way that the lowest-positioned one of the remainder of stacked articles (i.e., the second lowest-positioned article M2 in the stack) keeps its ordinary attitude in the storing space. Thereafter, the pusher 310 causes the remainder of the stack M2, on the article placement portion 312, see FIG. 7, to be supported by the pair of retaining parts 132*a* and 132*b* of the storing section 10 before the pusher 310 retreats from the storing space.

Accordingly, the article dispensing operation of the stacked articles M, one by one, is automatically performed without fail. In other words, malfunction of the article dispensing operation of stacked articles M one by one can be prevented.

Second Embodiment

In the aforementioned article dispensing apparatus 1 according to the first embodiment, the flap 152 is provided at the lower end of the first sidewall 102 of the storing section 10 in such a way as to be in contact with the pusher 310 located at the second dispensing position MP2. Because of this flap 152, during the moving process of the second U-shaped slider 280 from the first dispensing position MP1 to the first standby position SP1 along the x axis, the backward movement of the pusher 310 in the direction of −x is restrained and at the same time, the pusher 310 is moved from the second dispensing position MP2 to the second standby position SP2. However, the present invention is not limited to this structure.

An article dispensing apparatus according to a second embodiment is one of the variations of the aforementioned first embodiment.

Since the article dispensing apparatus according to the second embodiment has almost the same structure as that of the article dispensing apparatus 1 according to the first embodiment except for the flap 152, the explanation about the same structural elements as the first embodiment is omitted here by attaching the same reference numerals as those used in the first embodiment for the sake of simplification.

In the article dispensing apparatus according to the second embodiment, the flap 152 is not provided in the mechanism for moving the pusher 310 to the second dispensing position MP2 to the second standby position SP1. This mechanism is configured in such a way that the rear ends of the pair of brim portions 288*a* and 288*b* of the second U-shaped slider 280 abuts on the pair of leaf springs 240*a* and 240*b* before the pusher 310 is retreated from the storing section 10.

Because of this structure, when the first U-shaped slider 260 is moved backward in the direction of −x, the second U-shaped slider 280 starts its movement in the same direction of −x, in other words, from the first dispensing position MP1 to the first standby position SP1 along the x axis. However, the rear ends of the brim portions 288*a* and 288*b* of the second U-shaped slider 280 abuts respectively on the leaf springs 240*a* and 240*b* and therefore, the further movement of the second U-shaped slider 280 in the direction of −x is restrained.

When the first U-shaped slider 260 is further moved in the direction of −x, the second U-shaped slider 280 is not moved in the same direction of −x, and the first pin 274*a* is slid in the direction of −x along the x axis within the first elongated holes 290*a* and 290*b* of the second U-shaped slider 280. If the first pin 274*a* is moved in the direction of −x in this way, the inner edges of the elongated hole 318 of the link member 316*a* and the elongated hole 322 of the link member 316*c* are pushed forward by the first pin 274*a* along the x axis. Thus, the link members 316*a* and 316*c* are rotated around the shaft 298 with respect to the second U-shaped slider 280 in such a way as to move the pusher 310 to a second standby position SP2 from the second dispensing position MP2.

Similarly, when the first U-shaped slider 260 is further moved in the direction of −x, the second U-shaped slider 280 is not moved in the direction of −x, and the second pin 274*b* is slid in the direction of −x along the x axis within the second elongated holes 292*a* and 292*b* of the second U-shaped slider 280. If the second pin 274*b* is moved in the direction of −x in this way, the inner edges of the elongated hole 320 of the link member 316*b* and the elongated hole 324 of the link member 316*d* are pushed by the second pin 274*b* along the x axis. Thus, the link members 316*b* and 316*d* are rotated around the shaft 300 with respect to the second U-shaped slider 280 in such a way as to move the pusher 310 to the second standby position SP2 from the second dispensing position MP2.

When the pusher 310 is located at the second standby position SP2, the first pin 274*a* is located at the rear ends of the first elongated holes 290*a* and 290*b* of the second U-shaped slider 280 along the x axis, and the second pin 274*b* is located at the rear ends of the second elongated holes 292*a* and 292*b* of the second U-shaped slider 280 along the x axis. Therefore, almost all the force acting from the first U-shaped slider 260 which is moving in the direction of −x is transmitted to the second U-shaped slider 280 by way of the first and second pins 274*a* and 274*b*. In this case, the force for moving the second U-shaped slider 280 in the direction of −x exceeds the predetermined value for getting over the pair of leaf springs 240*a* and 240*b*. As a result, the rear ends of the brim portions 288*a* and 288*b* of the second U-shaped slider 280 get over the pair of leaf springs 240*a* and 240*b*, thereby moving the second U-shaped slider 280 in the direction of −x to the first standby position SP1.

When the second U-shaped slider 280 thus moved is detected by the first sensing element 362 of the slider sensing device 360, and it is judged that the second U-shaped slider 280 is located at the first standby position SP1, the dispensing operation of the articles M of the article dispensing apparatus of the second embodiment is finished.

Since the article dispensing apparatus according to the second embodiment has almost the same structure as that of the article dispensing apparatus 1 according to the first embodiment except for the flap 152, it is apparent that the article dispensing apparatus of the second embodiment has the same advantages as those of the first embodiment.

Other Embodiments

The present invention is not limited to the above-described embodiments and their variations. Other modifications are applicable to these embodiments and variations thereof.

For example, the dispensing section 20 may have any other structure and/or mechanism than those explained here if the first and second sliders conduct the same movements as those of the first and second embodiments.

Similarly, the storing section 10 and the control section may have any other structures and/or mechanisms than those explained here if they have the same functions as those of the first and second embodiments.

While the preferred forms of the present invention have been described, it is to be understood that modifications will be apparent to those skilled in the art without departing from the spirit of the invention. The scope of the present invention, therefore, is to be determined solely by the following claims.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. An article dispensing apparatus comprising:

a storing section for storing a stack of articles in a storing space, wherein a retainer for retaining the stack of articles is formed in the storing space, and a dispensing opening through which a lowest-positioned article is dispensed from the stack in a dispensing direction is formed to communicate with the storing space;

a dispensing section for dispensing the lowest-positioned article from the stack through the dispensing opening, wherein the dispensing section comprises a driving device, a first U-shaped slider which is moved by the driving device, a second U-shaped slider which is moved in conjunction with the first U-shaped slider, and a pusher which is moved in conjunction with the first U-shaped slider; and a controlling section for controlling operation of the driving device of the dispensing section;

wherein the pusher comprises an article placement portion on which a remainder of the articles is placed after the lowest-positioned article is dispensed from the stack;

during a dispensing operation, the pusher pushes forward the lowest-positioned article from its back, thereby dispensing the lowest-positioned article through the dispensing opening in the dispensing direction, and the pusher receives temporarily a remainder of the articles on the article placement portion in such a way that a lowest-positioned article in the remainder keeps its ordinary altitude in the storing space, the pusher causes the remainder placed on the article placement portion to be supported by the retainer of the storing section before the pusher retreats from the storing space, and a pusher restraining member for moving the pusher to a position at which the article placement portion of the pusher is lower than the retainer of the storing section in height when the pusher causes the remainder on the article placement portion to be supported by the retainer, wherein the pusher restraining member is a flap-like member rotably mounted on a horizontal shaft fixed in the storing section; and rotatable in a forward direction but not rotatable in a backward direction, thereby allowing the pusher to move forward and restraining the pusher from moving backward.

2. An article dispensing apparatus comprising:

a storing section for storing a stack of articles in a storing space, wherein a retainer for retaining the stack of articles is formed in the storing space, and a dispensing opening through which a lowest-positioned article is dispensed from the stack in a dispensing direction is formed to communicate with the storing space;

a dispensing section for dispensing the lowest-positioned article from the stack through the dispensing opening, wherein the dispensing section comprises a driving device, a first U-shaped slider which is moved by the driving device, a second U-shaped slider which is moved in conjunction with the first U-shaped slider, and a pusher which is moved in conjunction with the first U-shaped slider; and a controlling section for controlling operation of the driving device of the dispensing section;

wherein the pusher comprises an article placement portion on which a remainder of the articles is placed after the lowest-positioned article is dispensed from the stack;

during a dispensing operation, the pusher pushes forward the lowest-positioned article from its back, thereby dispensing the lowest-positioned article through the dispensing opening in the dispensing direction, and the pusher receives temporarily a remainder of the articles on the article placement portion in such a way that a lowest-positioned article in the remainder keeps its ordinary altitude in the storing space, the pusher causes the remainder placed on the article placement portion to be supported by the retainer of the storing section before the pusher retreats from the storing space, and a pusher restraining member for moving the pusher to a position at which the article placement portion of the pusher is lower than the retainer of the storing section in height when the pusher causes the remainder on the article placement portion to be supported by the retainer, wherein the pusher restraining member is a leaf spring fixed in the dispensing section in such a way that the second U-shaped slider abuts on the leaf spring; and wherein by setting a force for moving the second U-shaped slider backward applied from the driving device not to exceed a predetermined value, the second U-shaped slider is restrained from getting over the leaf spring, thereby restraining the pusher from moving backward.

3. An article dispensing apparatus comprising:

a storing section for storing a stack of articles in a storing space, wherein a retainer for retaining the stack of articles is formed in the storing space, and a dispensing opening through which a lowest-positioned article is dispensed from the stack in a dispensing direction is formed to communicate with the storing space;

a dispensing section for dispensing the lowest-positioned article from the stack through the dispensing opening, wherein the dispensing section comprises a driving device, a first U-shaped slider which is moved by the driving device, a second U-shaped slider which is moved in conjunction with the first U-shaped slider, and a pusher which is moved in conjunction with the first U-shaped slider; and a controlling section for controlling operation of the driving device of the dispensing section;

wherein the pusher comprises an article placement portion on which a remainder of the articles is placed after the lowest-positioned article is dispensed from the stack;

during a dispensing operation, the pusher pushes forward the lowest-positioned article from its back, thereby dispensing the lowest-positioned article through the dispensing opening in the dispensing direction, and the pusher receives temporarily a remainder of the articles on the article placement portion in such a way that a lowest-positioned article in the remainder keeps its ordinary altitude in the storing space; and the pusher causes the remainder placed on the article placement portion to be supported by the retainer of the storing section before the pusher retreats from the storing space wherein the pusher is movably connected to the first and second U-shaped sliders by way of a V-shaped linking mechanism, which comprises:

pins supported commonly by the first and second U-shaped sliders in such a way that the first and second U-shaped sliders are relatively movable;

first rocking shafts provided on the second U-shaped slider in such a way that the second U-shaped slider and the pusher are relatively movable;

second rocking shafts provided on the pusher in such a way that the second U-shaped slider and the pusher are relatively movable; and V-shaped link members provided at each side of the pusher and having elongated holes; and wherein the pins and the first rocking shafts are rotably engaged with the elongated holes of the V-shaped link members, so that the pusher is not only reciprocally moved along the dispensing direction but also rotably moved around the pins; and due to a reciprocating motion of the first U-shaped slider by way of the V-shaped linking mechanism, the pusher is moved to a position at which a pushing portion of the pusher is higher than the retainer of the storing section and lower than a top of the lowest-positioned article in height, or a position at which the article placement portion of the pusher is lower than the retainer of the storing section in height; and a base for supporting the first and second U-shaped sliders and the pusher;

wherein the base comprises a first guide for guiding the first U-shaped slider, and a second guide for guiding the second U-shaped slider; and wherein the first U-shaped slider is moved reciprocally by the driving device along the first guide, the second U-shaped slider is moved reciprocally by the first U-shaped slider along the second guide, the pusher is movably placed onto the second U-shaped slider and is moved reciprocally by the first U-shaped slider by way of the V-shaped linking mechanism.

4. The article dispensing apparatus according to claim 3, wherein the V-shaped linking mechanism comprises the V-shaped link members which are engaged with the pusher and the first and second U-shaped sliders and which have the elongated holes, and pins engaged with the elongated holes of the V-shaped link members; and the pusher conducts its operation in conjunction with a reciprocating motion of the first U-shaped slider by way of the V-shaped linking mechanism.

5. The article dispensing apparatus according to claim 4, wherein the reciprocating motion of the first U-shaped slider is performed by using a combination of a rack gear and a pinion gear.

6. The article dispensing apparatus according to claim 5, the rack gear is connected to the first movable member U-shaped slider, and a remaining portion of the rack gear is received in a tube.

7. The article dispensing apparatus according to claim 3, wherein when the pusher is moved forward to dispense the lowest-positioned article through the dispensing opening, a forward displacement of the remainder is prevented by an inner wall of the storing space.

8. The article dispensing apparatus according to claim 3, further comprising a pusher restraining member for moving the pusher to a position at which the article placement portion of the pusher is lower than the retainer of the storing section in height when the pusher causes the remainder on the article placement portion to be supported by the retainer.

9. The article dispensing apparatus according to claim 3, wherein the first guide is provided on a back of the base, and the second guide is provided on a surface of the base;

wherein the first U-shaped slider is moved reciprocally by way of a combination of a rack gear and a pinion gear, and the second U-shaped slider is moved reciprocally by way of pins which are engaged with elongated holes of the second U-shaped slider.

10. The article dispensing apparatus according to claim 3, further comprising a pair of sidewalls apart from each other at a predetermined interval, and a base for supporting the first and second U-shaped sliders and the pusher;

wherein the pair of sidewalls is located below the storing space, and the base is located between the pair of sidewalls; and wherein the base comprises a first guide for guiding the first U-shaped slider, and a second guide for guiding the second U-shaped slider;

whereby the first U-shaped slider is moved reciprocally by the driving device along the first guide, the second U-shaped slider is moved reciprocally by the first U-shaped slider along the second guide, and the pusher is movably placed onto the second U-shaped slider and is moved reciprocally by the first U-shaped slider by way of the V-shaped linking mechanism.

11. The article dispensing apparatus according to claim 3, wherein when the pusher pushes the lowest-positioned article from its back during the dispensing operation, the pusher is moved upward in response to a forward motion of the first U-shaped slider, thereby enabling a pushing portion of the pusher to push the lowest-positioned article toward the dispensing opening; and the pusher is moved downward in response to a backward motion of the first U-shaped slider, thereby causing the remainder placed on the article placement portion to be supported by the retainer of the storing section.

* * * * *